US007779489B2

(12) United States Patent
Finell

(10) Patent No.: US 7,779,489 B2
(45) Date of Patent: Aug. 24, 2010

(54) POTTY BENCH WITH STORAGE

(76) Inventor: Rebecca M. Finell, 1152 E. Cottonwood, Ln., Phoenix, AZ (US) 85048

( * ) Notice: Subject to any disclaimer, the term of this patent is extended or adjusted under 35 U.S.C. 154(b) by 1206 days.

(21) Appl. No.: 11/369,079

(22) Filed: Mar. 6, 2006

(65) Prior Publication Data

US 2007/0017015 A1 Jan. 25, 2007

Related U.S. Application Data

(60) Provisional application No. 60/700,465, filed on Jul. 19, 2005.

(51) Int. Cl.
*A47K 11/04* (2006.01)

(52) U.S. Cl. ..... 4/483

(58) Field of Classification Search ..... 4/449, 4/457, 458, 464, 465, 476–479, 483, 485, 4/902, 300.3, DIG. 5
See application file for complete search history.

(56) References Cited

U.S. PATENT DOCUMENTS 80,129 A * 7/1868 Brown ..... 4/476
1,292,640 A * 1/1919 Phelps ..... 242/592
2,686,320 A * 8/1954 Feldstein ..... 4/239
3,378,855 A * 4/1968 Springer ..... 4/354
4,199,826 A * 4/1980 Devereux ..... 4/479
5,309,580 A 5/1994 Amalsad et al.
5,359,737 A 11/1994 Hodge
5,978,976 A * 11/1999 Chai ..... 4/483
5,991,938 A 11/1999 Bonior
6,385,790 B1 5/2002 Abraham et al.

* cited by examiner

*Primary Examiner*—Gregory L Huson
*Assistant Examiner*—Janie Christiansen
(74) *Attorney, Agent, or Firm*—Parsons & Goltry; Michael W. Goltry; Robert A. Parsons

(57) ABSTRACT

A potty bench includes a base supporting a potty seat, and a potty seat opening into the base formed in the potty seat. The potty seat opening has opposing forward and rearward ends. A basin is carried by the base underlying the potty seat opening to collect waste from the potty seat opening. A splashguard carried by the basin, which has a shield projecting through the potty seat opening at the forward end thereof from the basin and upwardly relative to the potty seat. The shield includes a urine deflecting face upwardly relative to the potty seat facing the rearward end of the potty seat opening for deflecting urine from above the potty seat into the basin through the potty seat opening.

16 Claims, 21 Drawing Sheets

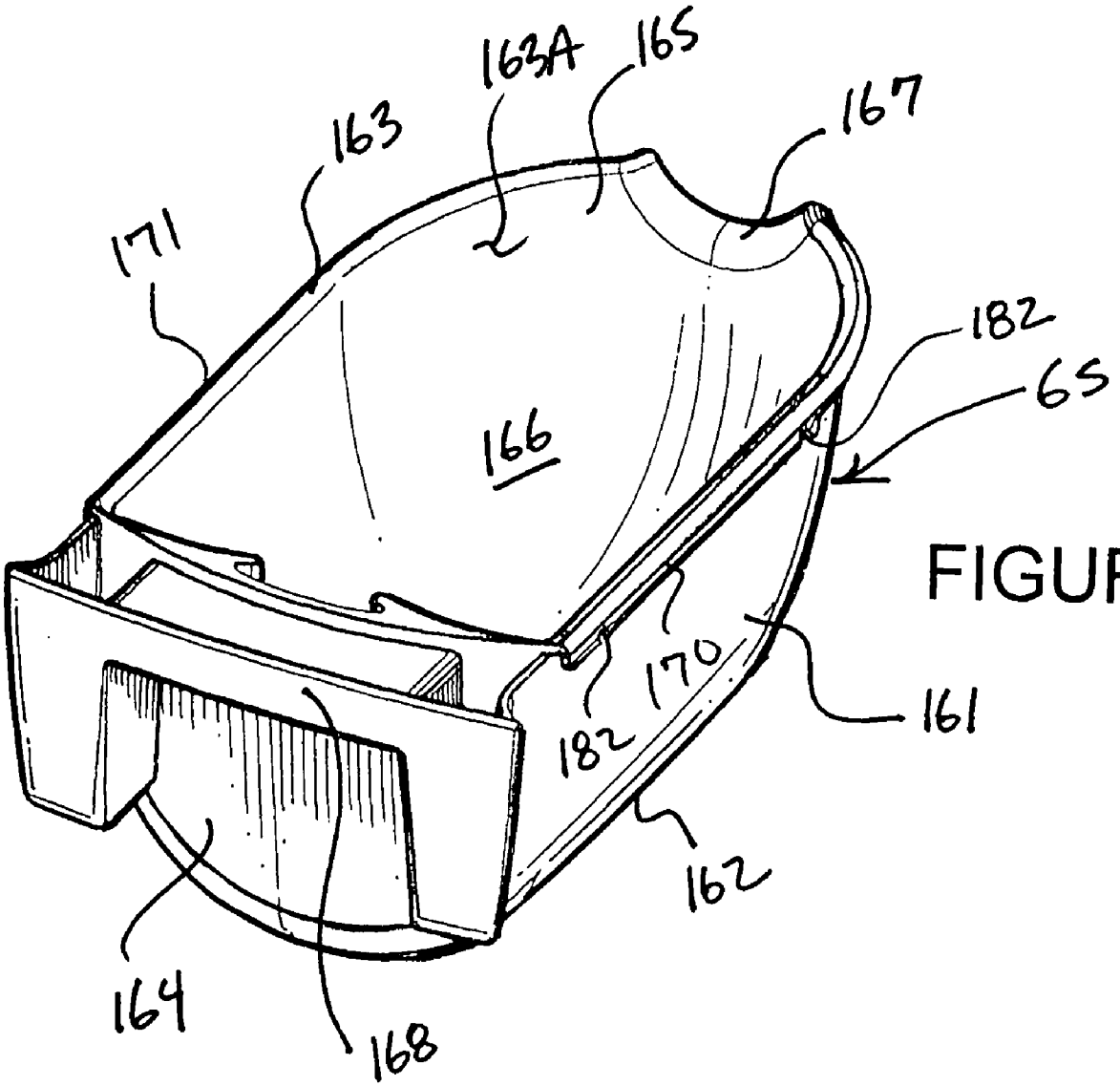
65
182
191
191
191

130
131
132
133
134
135
136
136A
137
138
139

POTTY BENCH WITH STORAGE

CROSS REFERENCE TO RELATED APPLICATION

This application claims the benefit of U.S. Provisional Application No. 60/700,465, filed 19 Jul. 2005.

FIELD OF THE INVENTION

The present invention relates to potty training devices and, more particularly, to training potties for assisting in potty training young children.

BACKGROUND OF THE INVENTION

Potty training marks an important developmental stage in young children. Although different experts espouse different methods for potty training, not all methods work for all children. Regardless of the method employed in potty training a young child, potty training requires patience, understanding, and the willingness to accept setbacks.

Most children show signs of readiness to begin using the toilet as toddlers, usually between eighteen (18) months and three (3) years of age. These signs include staying dry for at least two (2) hours at a time, having regular bowel movements, being able to follow simple instructions, being uncomfortable with dirty diapers and wanting them to be changed, asking to use the potty, or asking to wear regular underwear. Moreover, a suitable training potty should be put to use once a child exhibits a willingness to begin toilet training.

The training potty is one of the most important aspects of potty training because it constitutes the child's first exposure to a form of toilet. A suitable training potty must be easy to use, pleasing to the eye, easy to clean, and comfortable for the child. Although skilled artisans have devoted considerable effort toward the development of better and more efficient training potties, the state of the art of training potties suffers in the current efforts have yielded training potties that are difficult to clean, difficult to manufacture, and that have limited if any use apart from their primary utility as a waste collection device. Given these and other deficiencies in the art of potty benches, the need for continued improvement in the art is evident.

SUMMARY OF THE INVENTION

According to the invention, a potty bench includes a base supporting a potty seat, and a potty seat opening into the base formed in the potty seat. The potty seat has a seating surface sloped toward the potty seat opening, and the potty seat opening has opposing forward and rearward ends. A basin is carried by the base, which underlies the potty seat opening to collect waste from the potty seat opening. A splashguard is carried by the basin, which has a shield projecting through the potty seat opening at the forward end thereof from the basin and upwardly relative to the potty seat. The shield includes a urine deflecting face upwardly relative to the potty seat facing the rearward end of the potty seat opening for deflecting urine from above the potty seat into the basin through the potty seat opening. Preferably, the urine deflecting face is substantially concave. An engagement assembly removable attaches the splashguard to the basin, which includes an element thereof carried by the splashguard releasable coupled to a complemental element thereof carried by the basin. According to the principle of the invention, the element of the engagement assembly includes one of a male engagement element and a female engagement element, and the complemental element of the engagement assembly includes the other of the male engagement element and the female engagement element. Preferably, the splashguard consists of a deflectable body. The basin is removable from the base through an opening into the base, in which the deflectable body interacts with the potty seat in response to movement of the basin away from the base deflecting into the base permitting removal of the basin from the base.

According to the invention, a storage compartment is formed in the base. A closure for the storage compartment is mounted to the base for movement between an open position opening an access opening to the storage compartment and a closed position closing the access opening to the storage compartment. A lid is mounted to the base for movement between an open position relative to the potty seat and a closed position relative to the potty seat. A locking assembly interacts between the lid and the closure, whereby movement of the lid into its closed position in the closed position of the closure locks the closure in its closed position, and movement of the lid from its closed position to its open position in the closed position of the closure unlocks the closure from its closed position. A toilet paper spindle mounted to the base, and extends into the storage compartment. The storage compartment includes a support surface opposing the access opening. The spindle is mounted to the base for movement between a first position toward the access opening away from the support surface, and a second position toward the support surface and away from the access opening. According to the invention, the spindle is biased into its second position.

In yet another embodiment, the base has opposed sides, the potty seat is formed in the base between the respective sides, and a storage compartment formed in each of the respective sides of the base, in which there is a closure for each of the storage compartments mounted to the base for movement between open positions opening access openings to the respective storage compartments and closed positions closing the access openings to the respective storage compartments. A locking assembly is provided which interacts between the lid and the closures, whereby movement of the lid into its closed position in the closed positions of the closures locks the closures in their closed positions, and movement of the lid from its closed position to its open position in the closed positions of the closures unlocks the closures from their closed positions.

Consistent with the foregoing summary of preferred embodiments, and the ensuing detailed description, which are to be taken together, the invention also contemplates associated embodiments.

BRIEF DESCRIPTION OF THE DRAWINGS

Referring to the drawings:

FIG. 17 is a perspective view of the waste collection basin of FIG. 1;

DETAILED DESCRIPTION OF A PREFERRED EMBODIMENT

Figure 1:
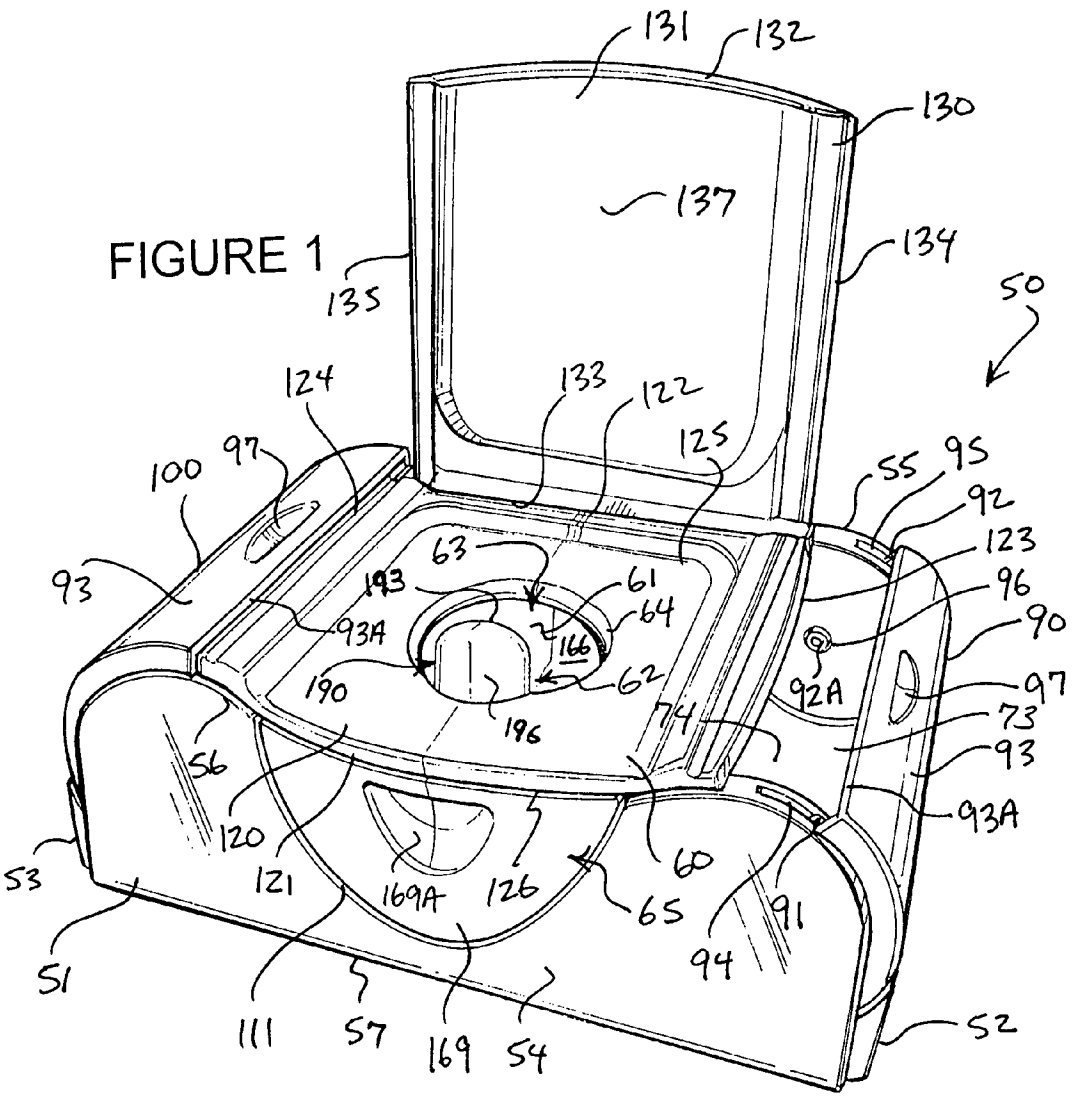
FIG. 1 is a perspective view of a potty bench constructed and arranged in accordance with the principle of the invention, the potty bench including a base and a lid attached thereto shown as it would appear in an open position revealing a splashguard supported by a waste collection basin positioned in the base underlying a potty seat formed with a potty seat opening.
Figure 7:
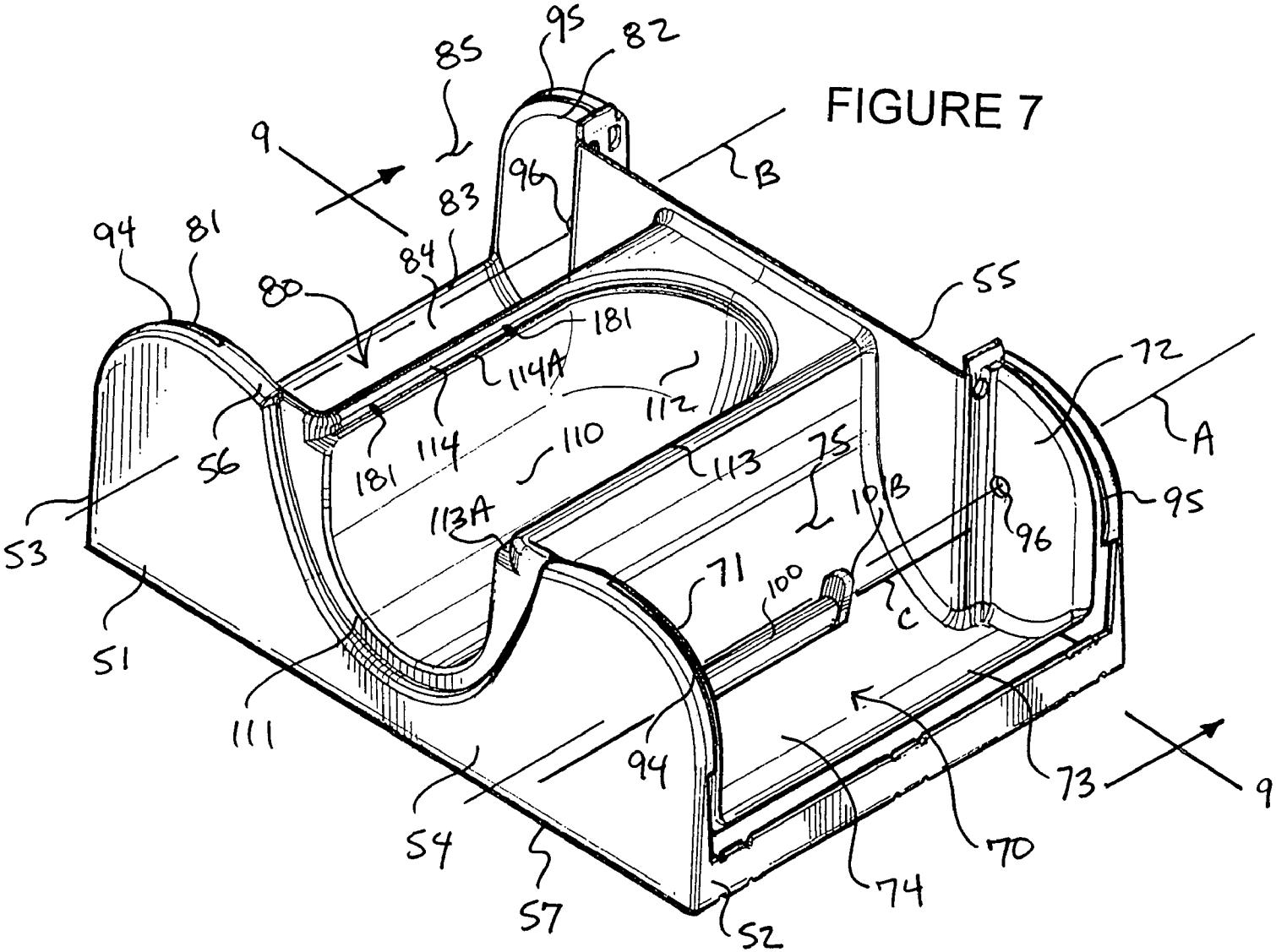
FIG. 7 is a top perspective view of the base of the potty bench of FIG. 1.

Turning now to the drawings, in which like reference characters indicate corresponding elements throughout the several views, attention is first directed to FIG. 1 in which there is seen a potty bench 50 constructed and arranged in accordance with the principle of the invention and that is typically used by a young child for potty training. Referring also to FIG. 7, bench 50 includes a base 51 having opposing sides 52 and 53, opposed front and back ends 54 and 55, a top 56, and an opposed bottom 57. As seen in FIG. 1, a potty seat 60 is formed in top 56 of base 50 between the respective sides 52 and 53, and a potty seat opening 61 into base 50 is formed in potty seat 61.

Figure 3:
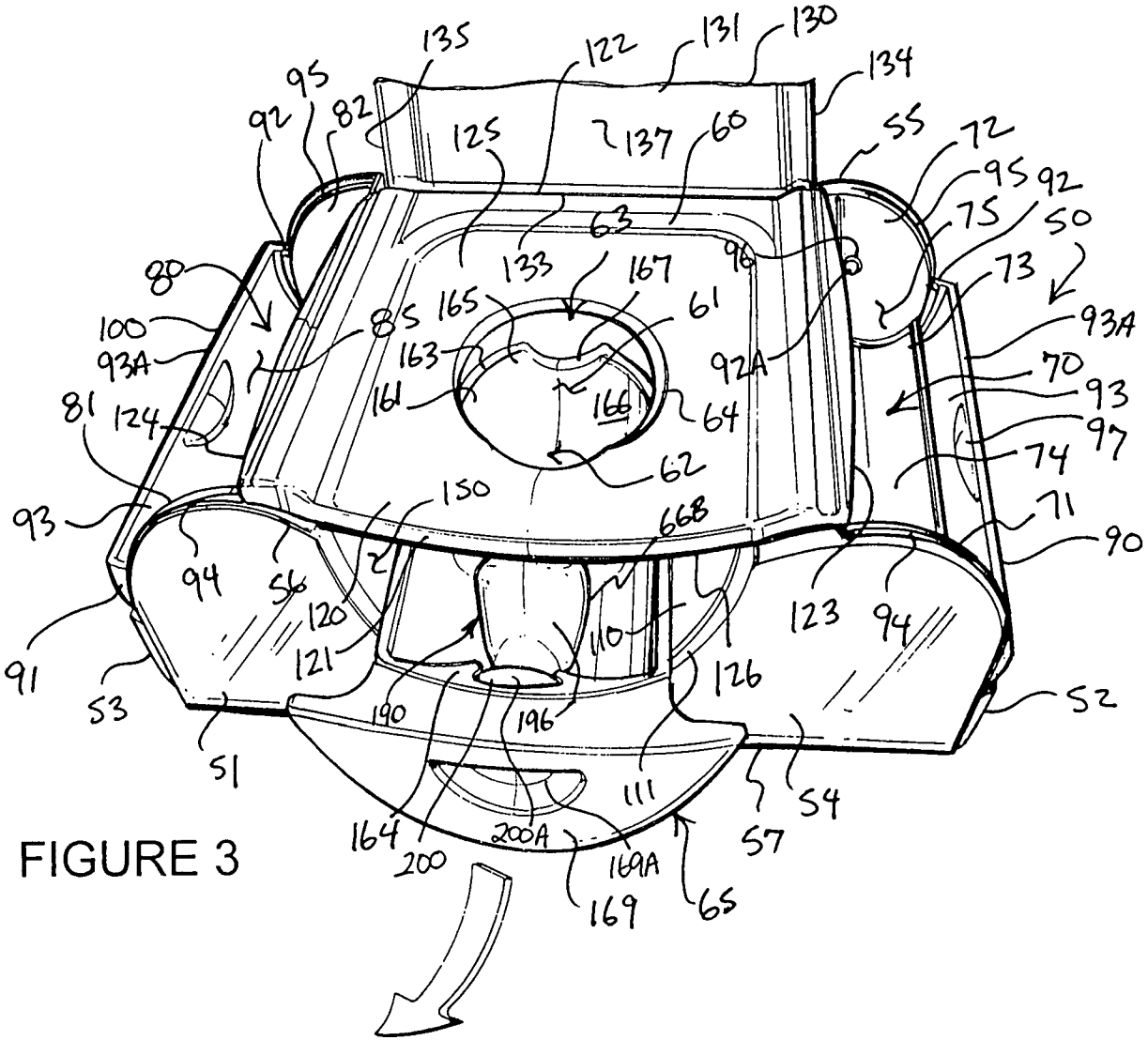
FIG. 3 is a perspective view of the potty bench of FIG. 1 shown with the waste collection basin as it would appear partially withdrawn from the base.

As best seen in FIG. 3, potty seat opening 61 has a forward end, designated generally at 62, directed toward front end 54 of base 50, and a rearward end, designated generally at 63, directed toward back end 55 of base 50. Referring to FIG. 1 and also to FIG. 4, a waste collection basin 65 is carried by base 50 in an operative position underlying potty seat opening 61 to collect waste, namely, feces and urine, from potty seat opening 61. A splashguard 190 is carried by basin 65, which projects through potty seat opening 61 at forward end 62 from basin 65 and upwardly relative to potty seat 60. Splashguard 190 has a front or outer face 196 facing front end 54 of base 50, and an opposing inner or urine deflecting face 195 facing rearward end 63 of potty seat opening 61 and back end 55 of base 50, which desirable deflects urine into basin 65 through potty seat opening 61, in accordance with the principle of the invention.

Figure 9:
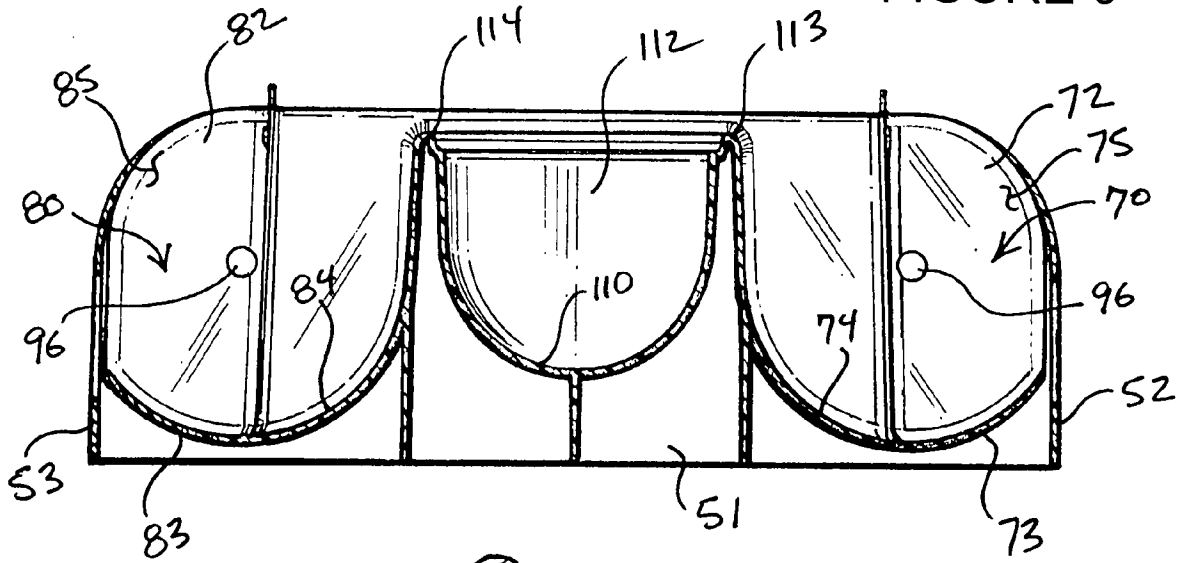
FIG. 9 is a sectional view taken along line 9-9 of FIG. 8

Referring to FIGS. 3, 7, and 9, storage compartments 70 and 80 are formed into sides 52 and 53, respectively, of base 50 into which items may be placed, such as cleansing wipes, toilet paper, baby powder, etc. Storage compartments 70 and 80 are substantially coextensive relative to one another. As best seen in FIG. 7, storage compartment 70 is generally defined by an endwall 71 disposed at front end 55 of base 50 at side 52, an opposing endwall 72 disposed at back end 55 of base 50 at side 52, and a cradle 73 extending therebetween, which defines a support surface 74 onto which items may be placed for storage. Base 51 also forms an access opening 75 into storage compartment 70. Storage compartment 70 defines a longitudinal axis A extending therethrough from front end 54 of base 51 to back end 55 of base 51 as referenced in FIG. 7.

Like storage compartment 70, storage compartment 80 is generally defined by an endwall 81 disposed at front end 55 of base 50 at side 52, an opposing endwall 82 disposed at back end 55 of base 50 at side 53, and a cradle 83 extending therebetween, which defines a support surface 84 onto which items may be placed for storage. Base 51 also forms an access opening 85 into storage compartment 80. Storage compartment 80 defines a longitudinal axis B extending therethrough from front end 54 of base 51 to back end 55 of base 51 as referenced in FIG. 7.

Base 51 is the main support of potty bench 50, in which bottom 57 is to be positioned onto a supporting surface. Referring back to FIG. 1, base 51 supports opposed doors or closures 90 and 100 for storage compartments 70 and 80, respectively. Closure 90 is mounted to base 51 at side 52 for movement between an open position opening an access opening 75 to storage compartment 70 and a closed position closing access opening 75 to storage compartment 70. Closure 100 is mounted to base 51 at side 53 for movement between an open position opening an access opening 75 to storage compartment 70 and a closed position closing access opening 75 to storage compartment 70. Closures 90 and 100 are entirely identical to each other with respect to their respective storage compartments and attachment to base 51. Accordingly, only closure 90 will be discussed in detail with the understanding that the ensuing discussion of closure 90 applies in every respect to closure 100 and that reference characters used to discuss closure 90 and its association with base 51 are also applied to closure 100 in the various figures where appropriate.

Figures 22, 23, 24, 25:
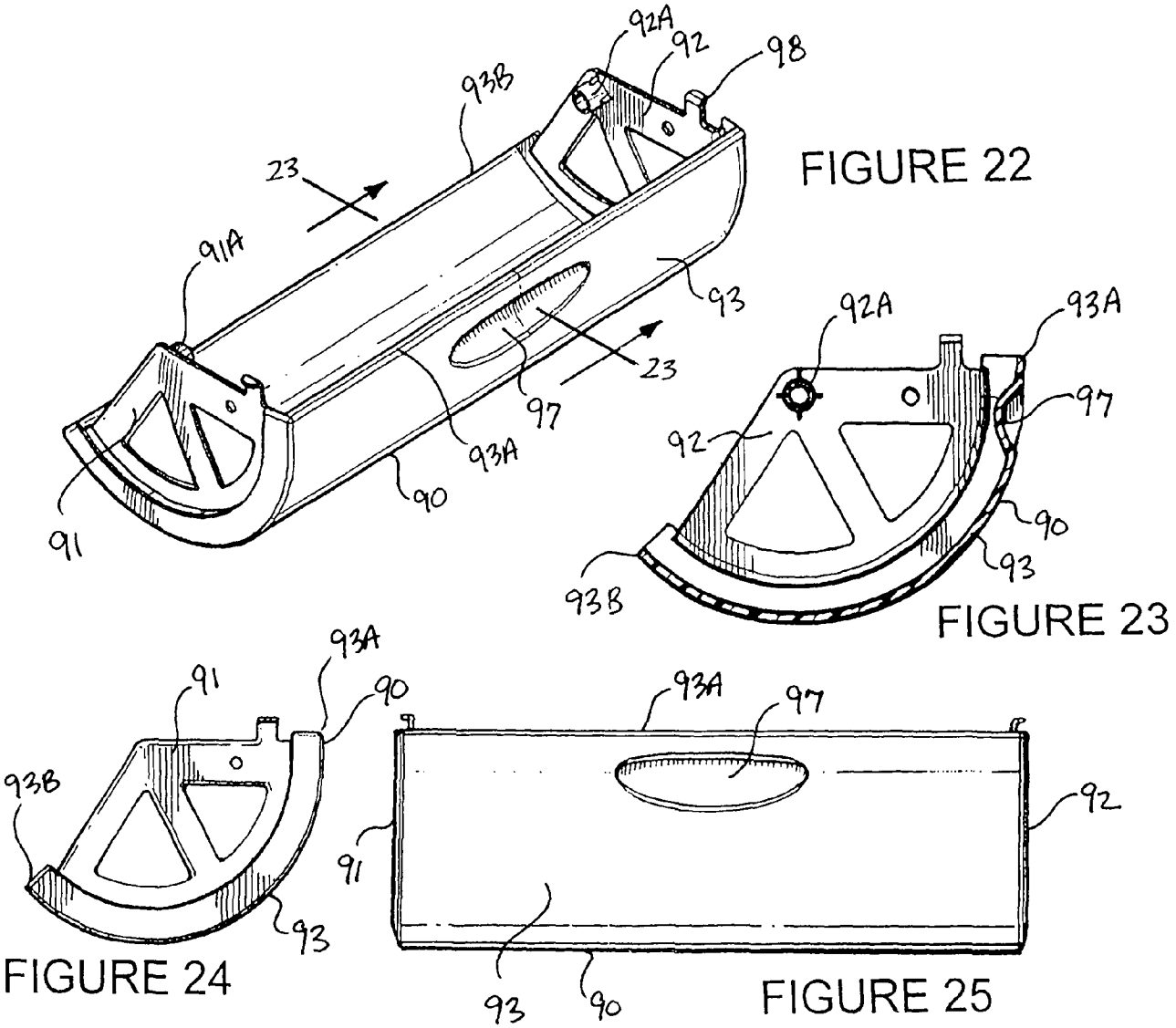
FIG. 22 is a perspective view of the closure of FIG. 13.
FIG. 23 is a sectional view taken along line 23-23 of FIG. 22.
FIG. 24 is an end elevational view of the closure of FIG. 13, the opposing end elevational view being substantially the same thereof.
FIG. 25 is an outer side elevational view of the closure of FIG. 13.

Referring to FIG. 22, closure 90 consists of opposed, parallel endwalls 91 and 92 interconnected by an inwardly curved sidewall 93 having opposing outer and inner edges 93A and 93B. FIG. 23 is a sectional view taken along line 23-23 of FIG. 22 illustrating sidewall 93 and its outer and inner edges 93A and 93B, and endwall 92. Endwalls 91 and 92 are formed with inwardly directed pintles 91A and 92A, respectively.

Figure 6A:
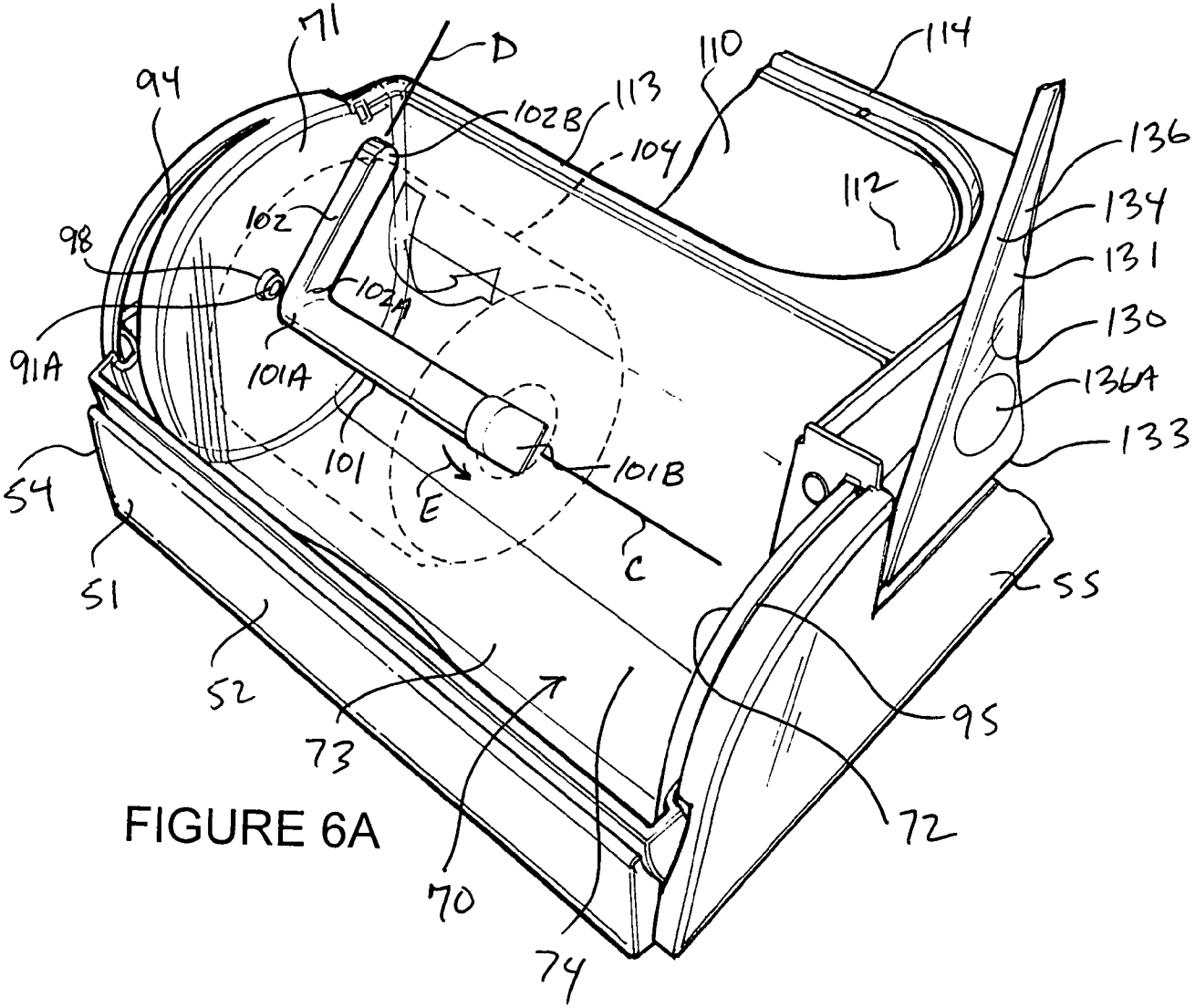
FIG. 6A is a fragmented perspective view of the potty bench of FIG. 1 illustrating a storage compartment thereof shown as it would appear open revealing a toilet paper spindle therein.
Figure 13:
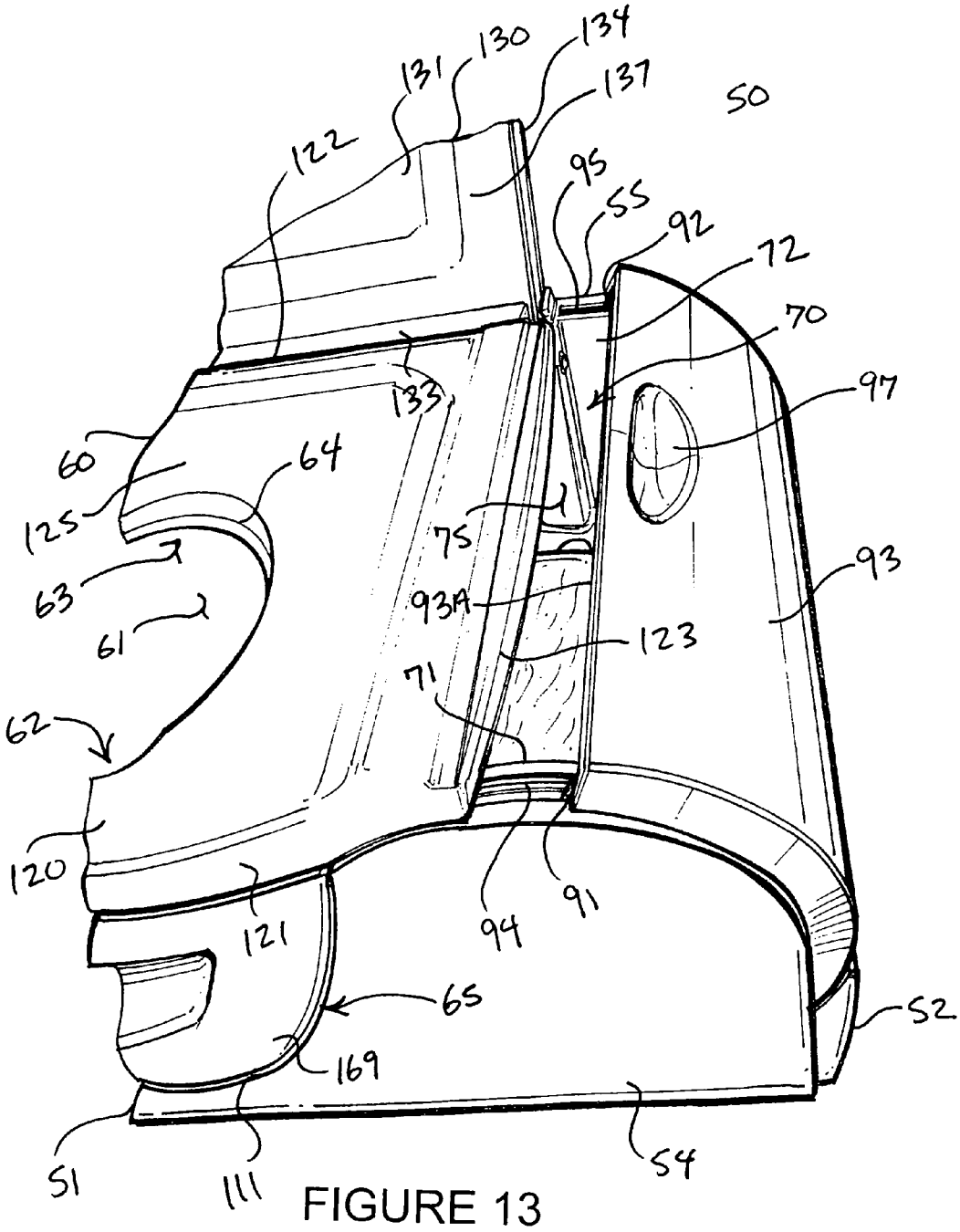
FIG. 13 is an enlarged fragmented perspective view of the potty bench of FIG. 1 showing the lid as it would appear open and a closure for a storage compartment formed in the base as it would appear partially open.

Looking to FIG. 7, slots 94 and 95 are formed in endwalls 71 and 72, respectively. Referring to FIGS. 1 and 13, endwalls 91 and 92 are inserted into slots 94 and 95, respectively, in which outer edge 93A is directed upwardly toward top 56 of base 51, and inner edge 93B (not shown) is directed into base 51 at bottom 57. As seen in FIG. 1, pintle 92A is received in a corresponding opening 96 formed in endwall 72 thereby producing a pivotal attachment therebetween. As seen in FIG. 6A, pintle 91A also is received in a corresponding opening 98 formed in endwall 71 thereby producing a pivotal attachment therebetween in exactly the same way as pintle 92A and its corresponding opening 96.

According to the invention, closure 90 pivots at pintles 91A and 92A relative to base 51 between its open/raised position as seen in FIG. 1 closing access opening 75 (not shown in FIG. 1) to storage compartment 70, and its closed/lowered position as seen in FIG. 3 opening access opening 75 to storage compartment 70. In this embodiment, closure 90 pivots about longitudinal axis A through storage compartment 70. Sidewall 94 is formed with a handle 97 located at a generally intermediate position between endwalls 91 and 92 adjacent to outer edge 93A, which aids a user in grasping closure 90 by hand for moving it between its open and closed positions. In this instance, handle 97 is an indentation formed into sidewall 93, although any suitable form of handle capable of aiding a user in taken up and moving closure 90 by hand can be used without departing from the invention.

The pintles carried by closure 90 and the corresponding openings carried by base 51 are used to produce a pivotal attachment of closure 90 relative to base 51. It is to be understood that although pintles are carried by closure 90 and the corresponding openings are carried by base 51, this arrangement can be reversed, if desired. Also, any suitable form of pivotal attachment can be formed and used between closure 90 and base 51 without departing from the principle of the invention.

Looking now to FIG. 6A there is seen a fragmented perspective view of potty bench 50 illustrating storage compartment 70 as it would appear with closure 90 in its open position opening access opening 75 to storage compartment 70. Mounted in storage compartment is a toilet paper roll spindle 101, which extends into and is suspended in storage compartment 70, and which is used to hold a toilet paper roll 104 for use in cleaning chiefly after defecation and urination.

Spindle 101 is an elongate body and has opposing inner and outer ends 101A and 101B, respectively, and defines a longitudinal axis C extending therethrough from inner end 101A to outer end 101B, which is also referenced in FIG. 7. Longitudinal axis C is substantially parallel relative to longitudinal axis A of storage compartment 70 as shown in FIG. 7. Inner end 101A of toilet paper spindle is in turn affixed to an outer end 102A of a pivoting arm 102, which has an opposing inner end 102B mounted to endwall 71 for pivotal movement. Pivoting arm 102 defines a longitudinal axis D extending therethrough from outer end 102A to inner end 102B, which is perpendicular relative to longitudinal axis C through toilet paper spindle 102.

Pivoting arm 102 rests substantially flush against the inner surface of endwall 71 facing into storage compartment 70 as seen in FIG. 6A. Pivoting arm 102 is disposed at an oblique angle. In particular, inner end 102B is directed upwardly toward top 56 of base 51 and is located adjacent to rail 113. Arm 102 projects downwardly along the inner surface of endwall 71 from inner end 102 and is angled outwardly toward side 52 of base 51 to outer end 102A, which is located generally centrally of the inner surface of endwall 71, thereby suspending spindle 101 at a generally central location in storage compartment 70, as shown.

Because outer end 102A of pivoting arm 102 supports spindle 101 at a location that is below and away from inner end 102A of pivoting arm 102, spindle 101 is inherently biased downwardly toward support surface 74 of cradle 73 in the direction indicated by the arrowed line E in FIG. 6A when bottom 57 of base is positioned onto a generally horizontal supporting surface in preparation for use of potty seat 50 according to the teachings set forth in this disclosure. As a result, when a toilet paper roll 104 (denoted in dotted outline) is received about spindle 101, the weight of toilet paper roll 104 acts on spindle 101 causing inner end 101A of pivoting arm 101 to pivot moving spindle 101 downwardly in the direction indicated by the arrowed line E until the outer surface of toilet paper roll 104 comes to rest against support surface 74. As toilet paper is unwound relative to toilet paper roll 104, the weight of toilet paper roll 104 acting on spindle 101 constantly draws spindle 101 toward support surface 74 maintaining toilet paper roll 104 in frictional engagement with support surface 74 as the toilet paper is unwound therefrom thereby preventing the toilet paper roll 104 from unrolling uncontrolled, in accordance with the principle of the invention. If desired, the bias applied to spindle 101 can be augmented with a biasing element or device, such as a compression spring, a rubber band, etc.

Figure 6B:
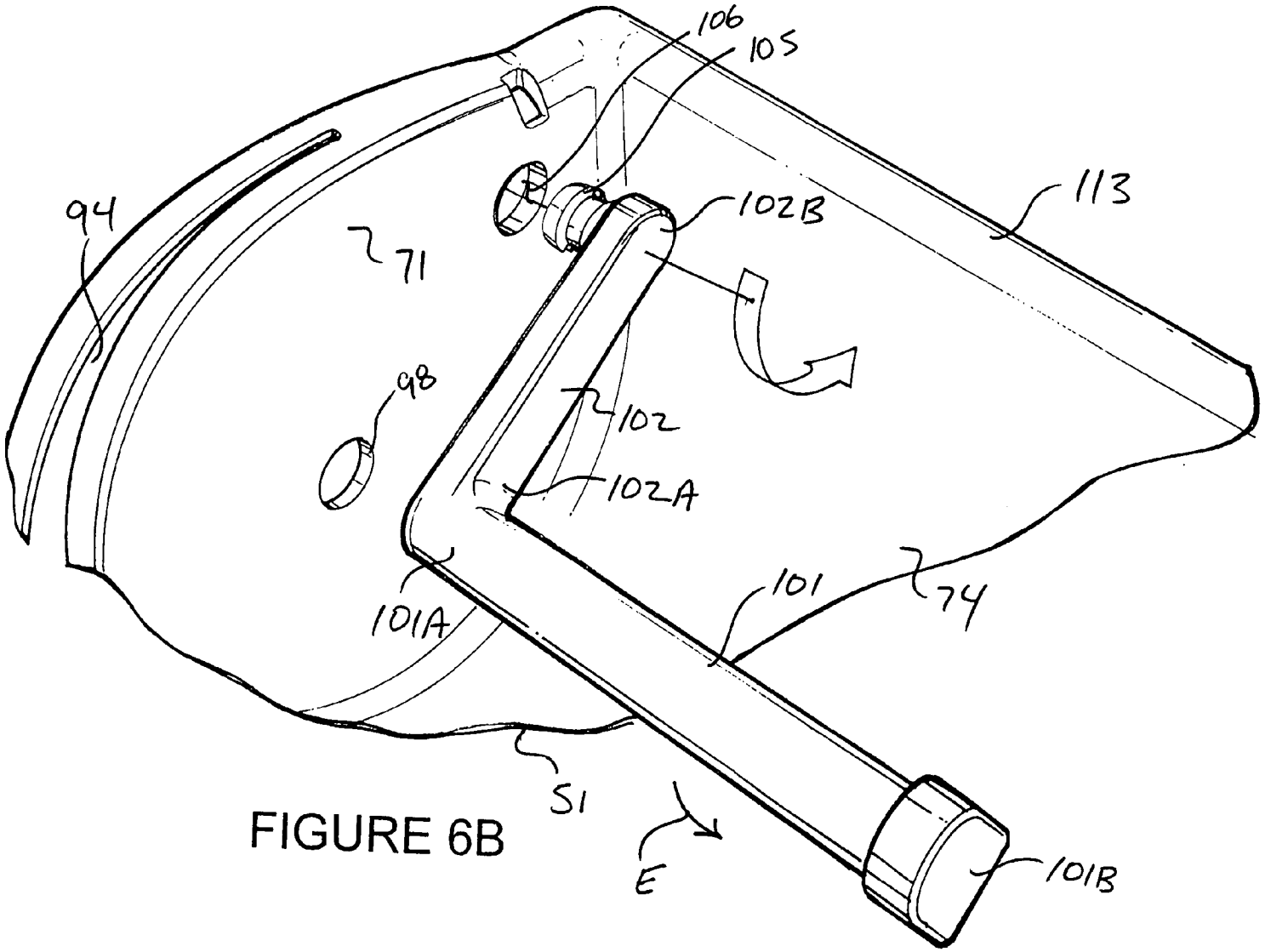
FIG. 6B is an enlarged fragmented view of the potty bench of FIG. 6A illustrating the spindle detached from the base.

Referring briefly to FIG. 6B, inner end 102B of pivoting arm 102 is formed with a pintle 105, which is received into a corresponding opening 106 formed in endwall 71 thereby producing the pivotal attachment therebetween endwall 71 and inner end 102B of pivoting arm 102. Pintle 105 carried by inner end 102B of pivoting arm 102 and the corresponding opening 106 carried by endwall 71 is used to produce a pivotal attachment of pivoting arm 102 to endwall 71. It is to be understood that although pintle 105 is carried by inner end 102B and opening 106 is carried by endwall 71, this arrangement can be reversed, if desired. Also, any suitable form of pivotal attachment can be formed and used between inner end 102A and endwall 71 without departing from the invention.

Figure 4:
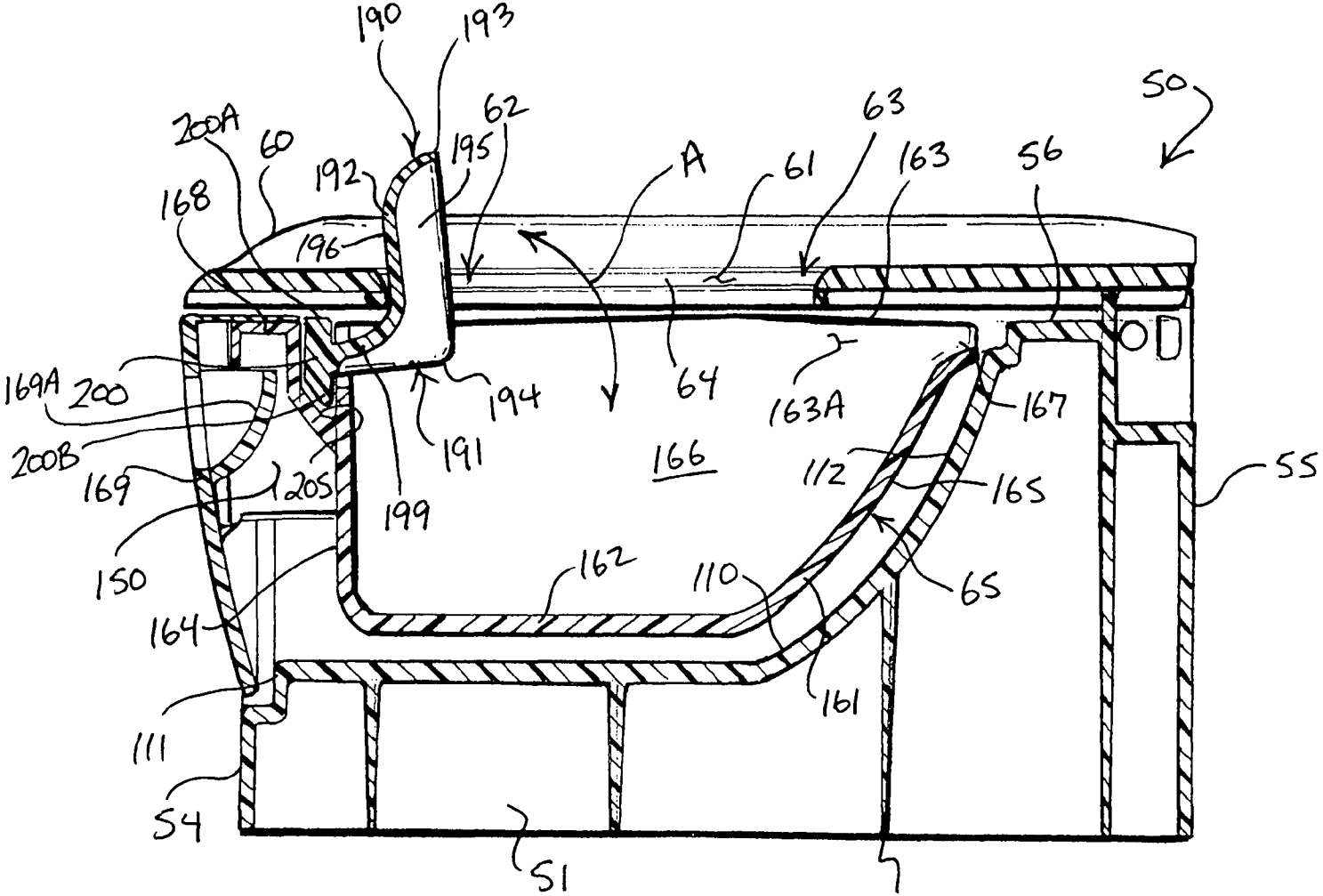
FIG. 4 is a sectional view taken along line 4-4 of FIG. 1 with the lid removed.

Referring back to FIG. 7, base 51 is formed with a basin cradle 110 between storage compartments 70 and 80, into which basin 65 is set as shown in FIGS. 1 and 4. Basin cradle 110 is a generally bowl-shaped extending into base 51 from top 56, and has an open end 111 formed at front end 54 of base 51, and an opposing closed end 112 formed at rear end 55 of base 51. More particularly, and with additional reference to FIG. 9, basin cradle 110 extends into base 51 from opposed parallel rails 113 and 114 formed at top 56 of base 51 inwardly of storage compartments 70 and 80, respectively.

Potty seat 60 is a separate component that is set onto top 56 between storage compartments 70 and 80 thereby forming top 56 with potty seat 60. In this preferred embodiment, potty seat 60 rests chiefly on rails 113 and 114, respectively, formed in top 56. Potty seat 60 can, if desired, be integrally formed with top 56.

Figure 26:
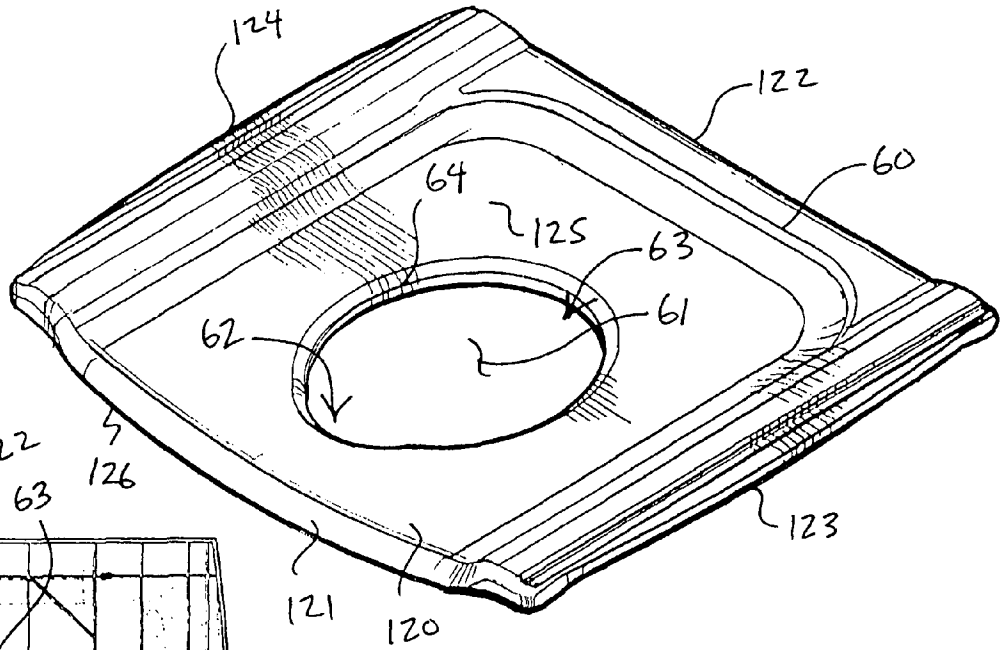
FIG. 26 is a perspective view of the potty seat of the potty bench of FIG. 1.
Figure 27:
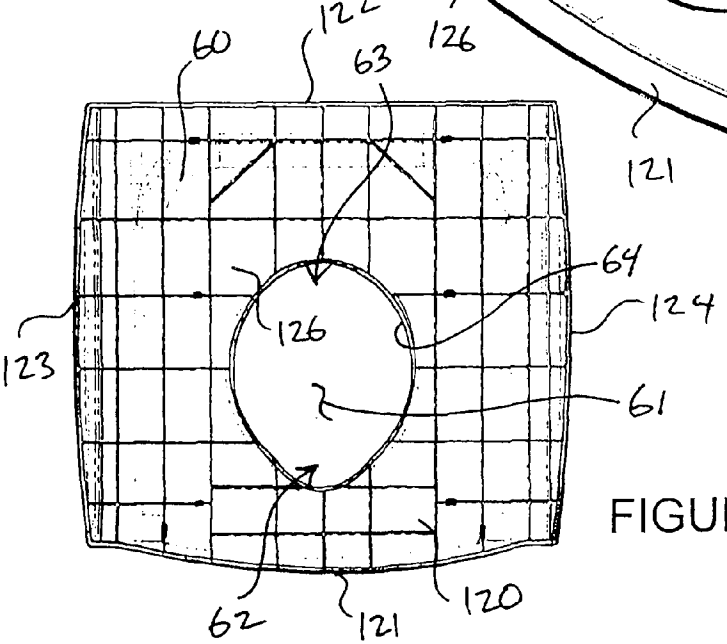
FIG. 27 is a bottom plan view of the potty seat of FIG. 26.

Looking to FIG. 26, potty seat 60 consists of an integrated body 120 having opposing front and rear extremities 121 and 122, opposing side extremities 123 and 124, an upper seating face 125, and an opposing lower face 126, which can also be seen in FIG. 27. When properly set onto top 56 as shown in FIGS. 1 and 3, lower face 126 faces into basin cradle 110, seating face 125 faces upwardly and is available to be sat upon by a small child during use of potty bench 50, side extremity 123 is positioned against rail 113 (not shown in FIGS. 1 and 3), side extremity 124 is positioned against rail 114 (not shown in FIGS. 1 and 3), and potty seat opening 61 overlies basin cradle 110. Potty seat opening 61 through potty seat 60 is generally centrally located, and is bound or otherwise defined by an annular rim 64 formed in body 120. Seating face 125 is generally frustoconical in shape tapering inwardly toward rim 64 for directing fluids, such as urine, to potty seat opening 61.

According to the principle of the invention, when closures 90 and 100 are disposed in their closed positions closing their respective storage compartments 70 and 80, outer edges 93A of closures 90 and 100 overlie side extremities 123 and 124, respectively. FIG. 1 shows closure 100 as it would appear in its closed position, in which outer edge 93A is shown overlying side extremity 124. When closure 90 is disposed in its closed position, its outer edge 93A overlies side extremity 123 in exactly the same way.

Figure 2:
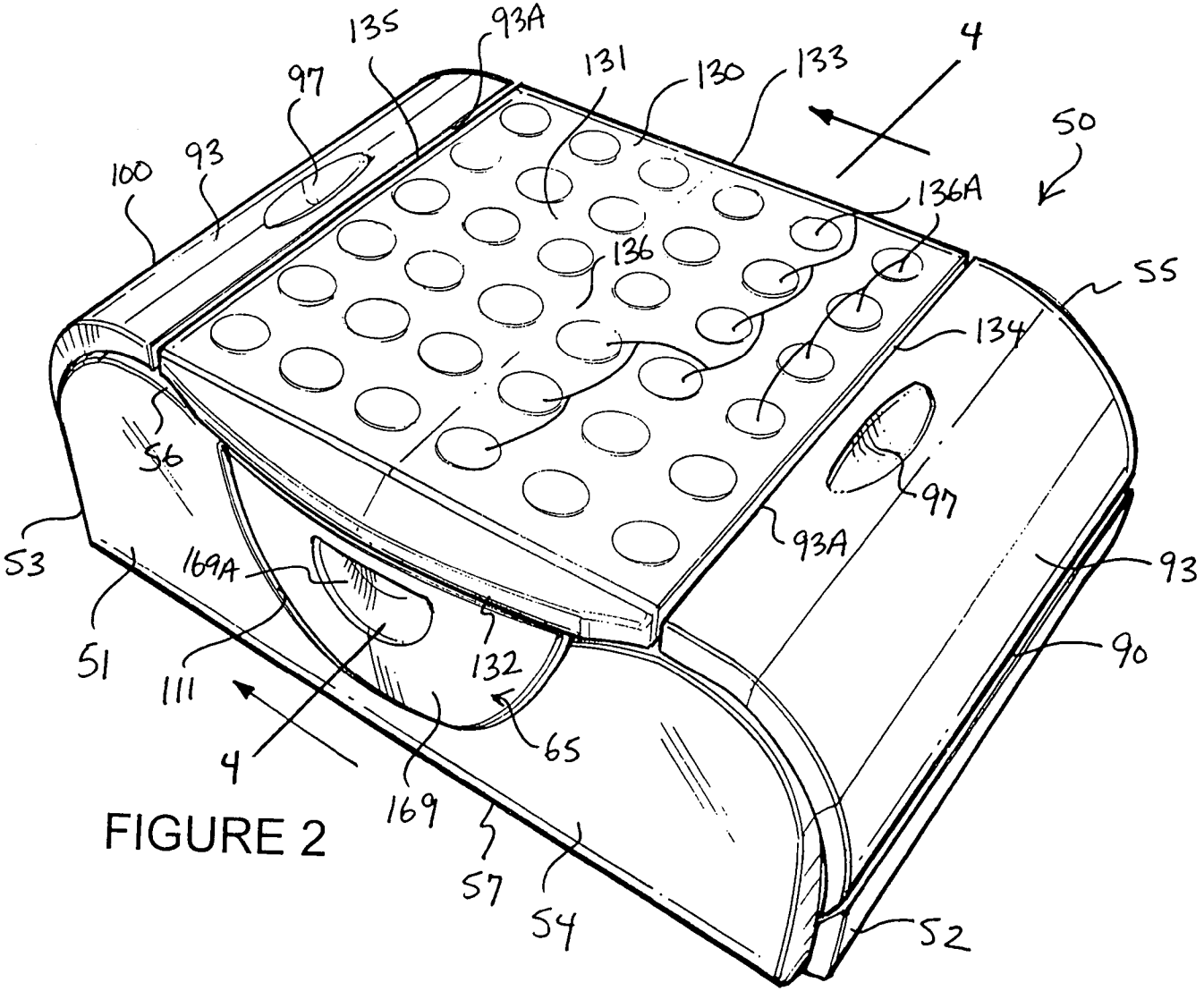
FIG. 2 is a perspective view of the potty bench of FIG. 1 shown with the lid as it would appear in a closed position.

Referring back to FIG. 1, potty bench 50 is fashioned with a lid 130, which is mounted to back end 55 of base 51 between storage compartments 70 and 80 for movement between an open/raised position relative to potty seat 60 situated on top 56 of base 51 and a closed/lowered position relative to potty seat 60 situated on top 56 of base 51. FIG. 2 illustrates lid 130 as it would appear in its closed/lowered position. In its open position, lid 130 is raised away from potty seat 60 as shown in FIG. 1 in preparation for use of potty bench 50 in the normal manner, in which case a young child may use potty bench for defecation and urination. In its closed position 130, lid 130 is lowered onto potty seat 60 and comes to rest on potty seat 60 as seen in FIG. 2 thereby placing potty bench 50 into a stool configuration.

Figures 28, 29, 30:
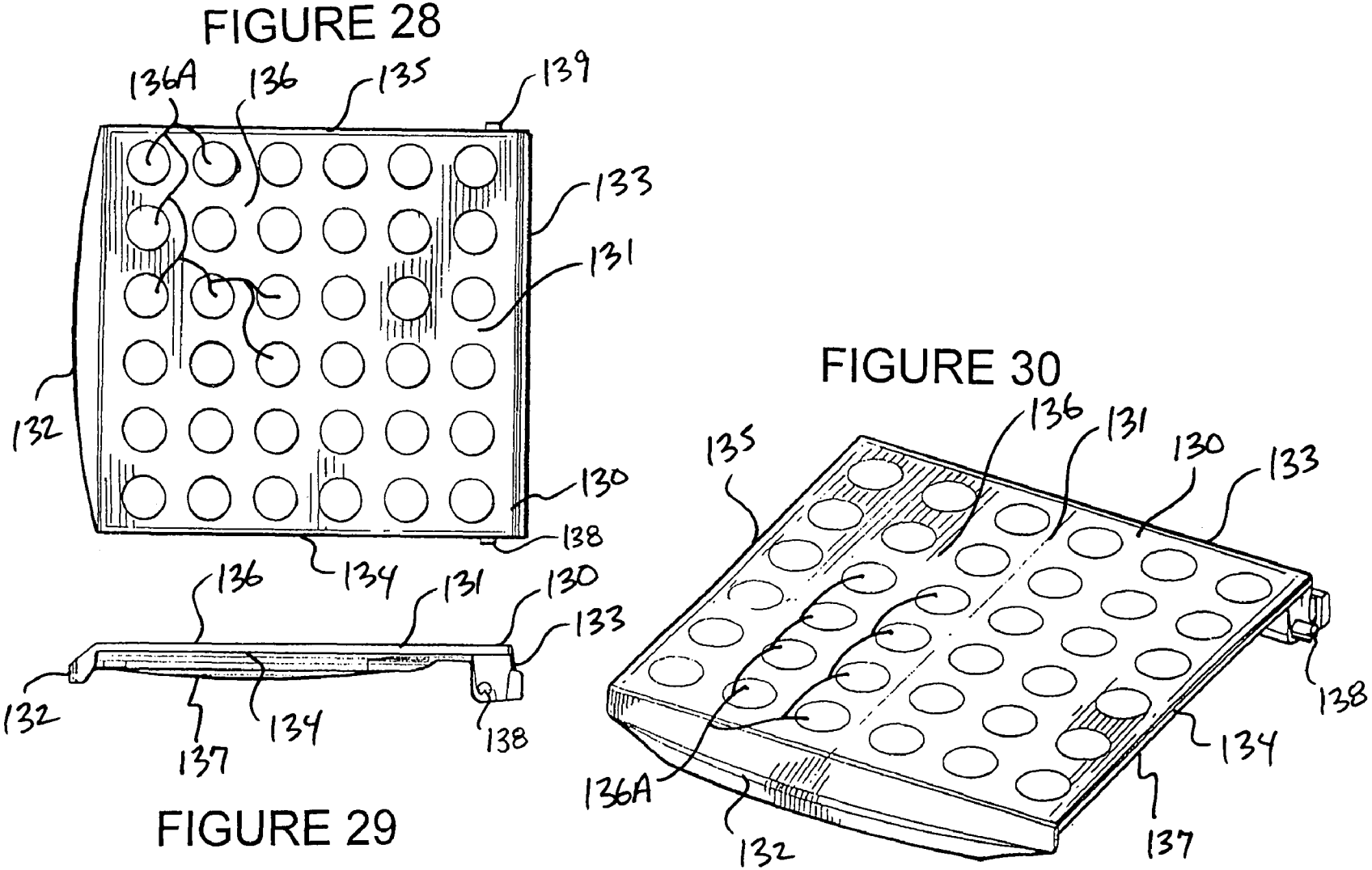
FIG. 28 is a top plan view of the lid of the potty bench of FIG. 1.
FIG. 29 is a side elevational view of the lid of FIG. 28, the opposing side elevational view being substantially the same thereof.
FIG. 30 is a perspective view of the lid of FIG. 28.

Referring to FIGS. 28 and 30, lid 130 consists of an integrated body 131 having opposing front and rear extremities 132 and 133, opposing side extremities 134 and 135, an upper/outer face 136 formed with a pattern of skid-resistant elements 136A, and an opposing lower/inner face 137 as shown in FIGS. 29 and 30. As a matter of disclosure, FIG. 29 is a side elevational view of lid 130, in which the opposing side elevational view is substantially the same thereof.

In this specific embodiment, lid 130 is formed with pintles 138 and 139. Pintle 138 is formed at rear extremity 133 of lid 130, and projects outwardly from side extremity 134. Pintle 139 is formed at rear extremity 133 of lid 130, and projects outwardly from side extremity 135. Pintle 138 is received into a corresponding opening 140 formed in an upstanding dividing wall 141 formed at top 56 of base 51 toward storage compartment 70 at back end 55 of base 21 as referenced in FIG. 14, and pintle 139 is likewise received into a corresponding opening (not shown) formed in a corresponding dividing wall formed in top 56 of base 51 toward storage compartment 90 at back end 55 of base 21, thereby producing a pivotal attachment therebetween facilitating the pivotal movement of lid 130 between its open and closed positions.

Lid 130 pivots at pintles 138 and 139 relative to potty seat 60 positioned on top 56 of base 51 as shown in FIG. 1 between its open position as seen in FIG. 1 and its closed position as shown in FIG. 2 overlying potty seat 60. The pintles carried by lid 130 and the corresponding openings carried by base 51 are used to produce a pivotal attachment of lid 130 relative to base 51. It is to be understood that although pintles are carried by lid 130 and the corresponding openings are carried by base 51, this arrangement can be reversed, if desired. Also, any suitable form of pivotal or hinged attachment can be formed and used between lid 130 and base 51 without departing from the principle of the invention for facilitating the movement of lid 130 between its open and closed position. Also, with lid 130 closed in the stool configuration of potty bench 50 as represented in FIG. 2, a user may use potty bench 50 as a stool by stepping up onto upper face 136, in which skid-resistant elements 136A inhibit slipping. In this embodiment, skid-resistant elements 136A are raised features disposed in spaced-apart relation in a pattern of rows. Upper face 136 can be formed with any suitable features capable of inhibiting a user standing thereon from slipping without departing from the invention.

Potty bench 50 incorporates a locking assembly that interacts between lid 130 and closure 90, whereby movement of lid 130 into its closed position in the closed position of closure 90 locks closure 90 in its closed position, and movement of lid 130 from its closed position to its open position in the closed position of closure 90 unlocks closure 90 from its closed position, in accordance with the principle of the invention.

Figure 14:
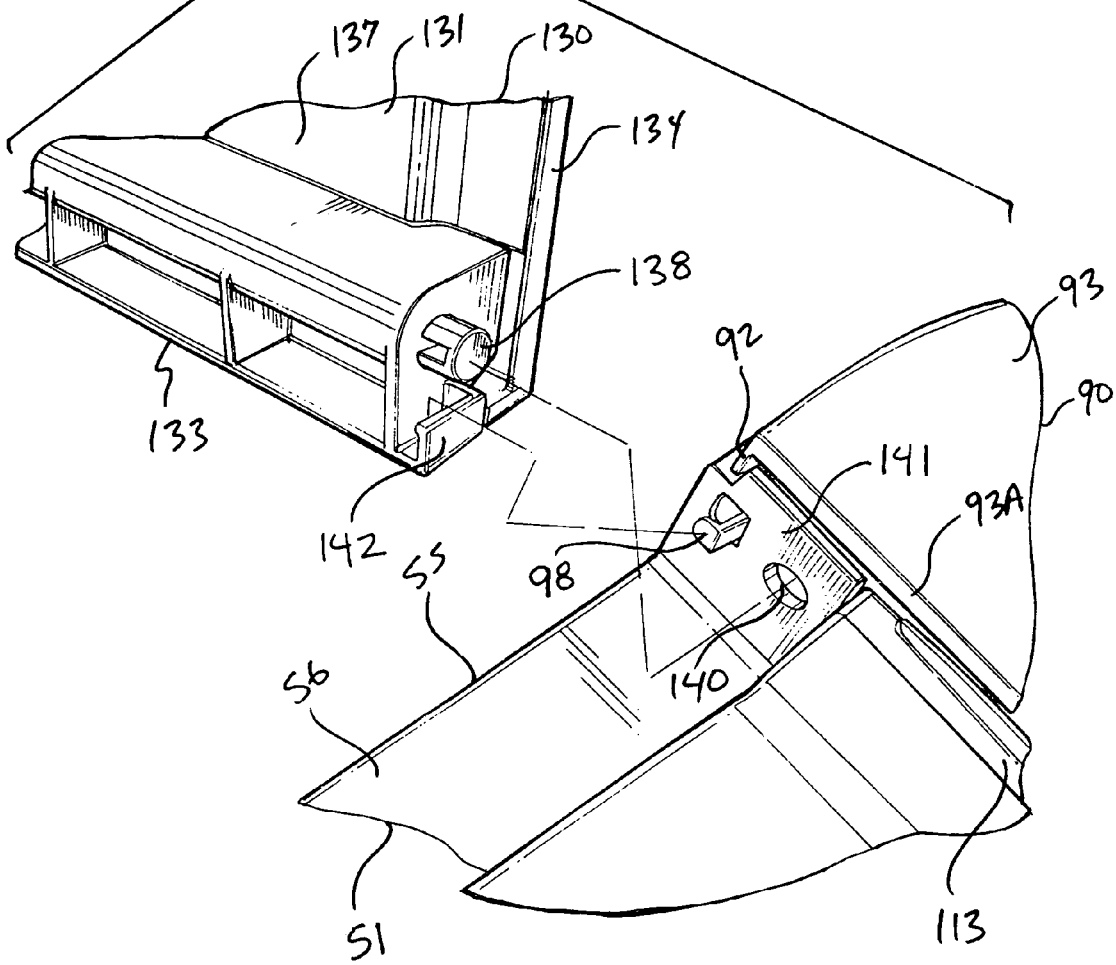
FIG. 14 is a fragmented exploded perspective view of the lid and the closure of FIG. 13 illustrating an element of an engagement pair carried by the lid and a complemental element of the engagement pair carried by the closure.
Figure 15A:
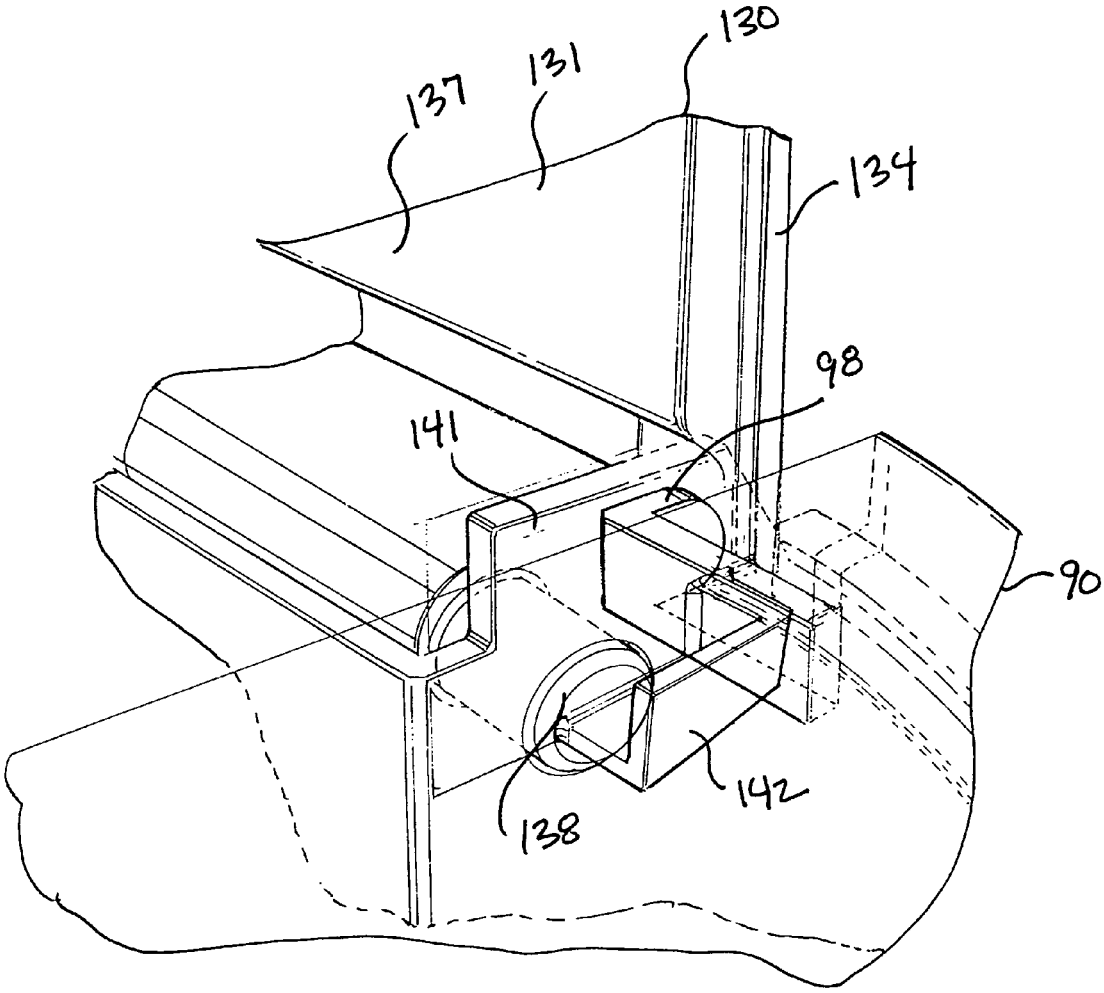
FIG. 15A is a fragmented, partially schematic perspective view of the lid and closure of FIG. 14 illustrating the positioning of the engagement pair in an unlocked position in the open position of the lid and the closed position of the closure.
Figure 15B:
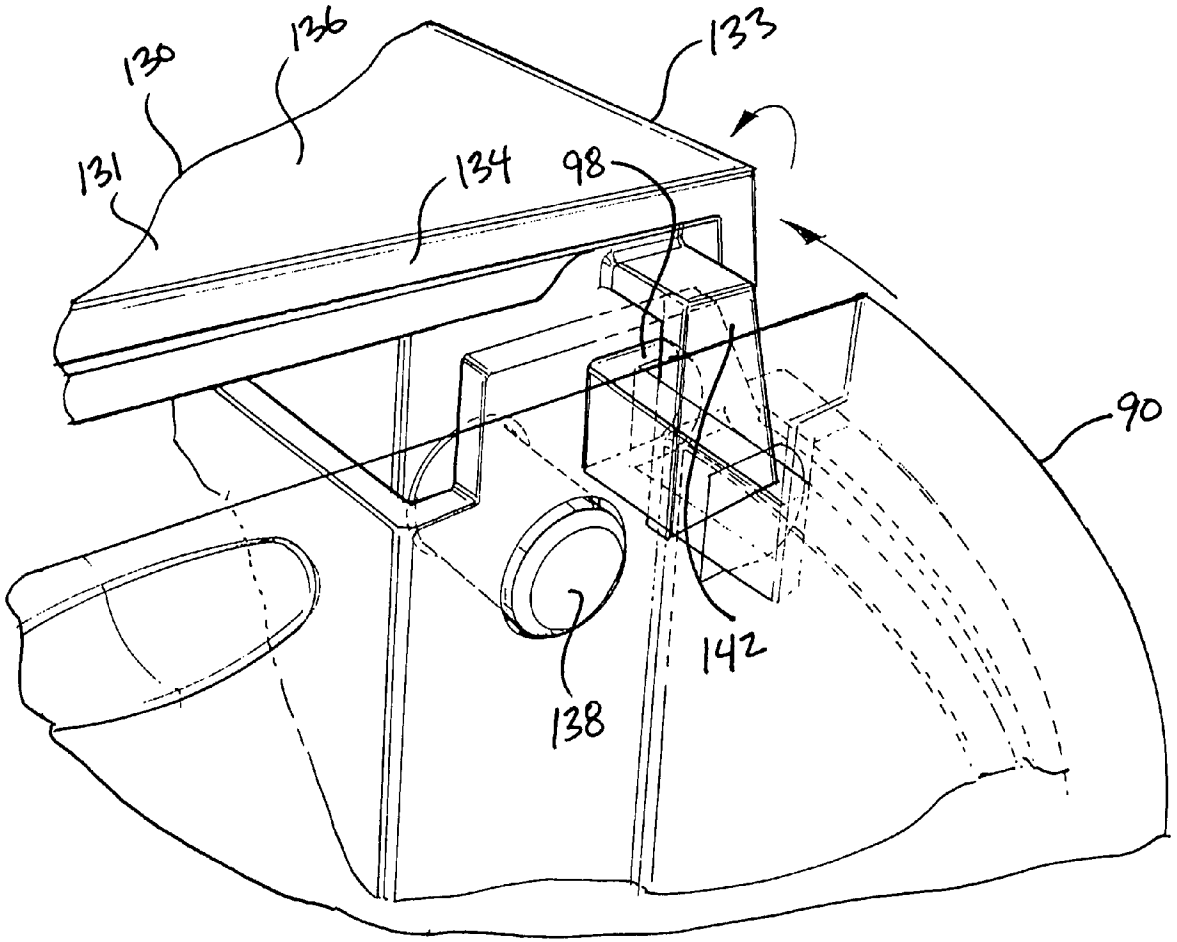
FIG. 15B is a view very similar to the of FIG. 15A illustrating the positioning of the engagement pair in a locked position in the closed position of the lid and the closed position of the closure.
Figure 16A:
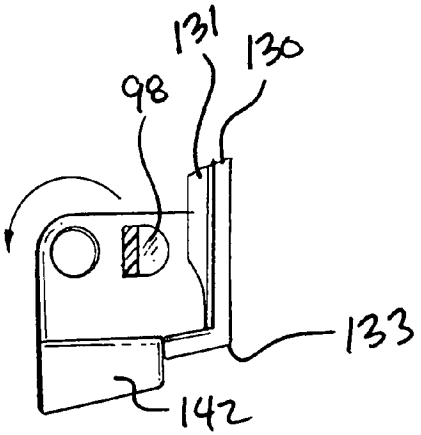
FIG. 16A is a fragmented, partially schematic side elevational view of the engagement pair of FIG. 14 in their unlocked position in the open position of the lid and the closed position of the closure.
Figure 16B:
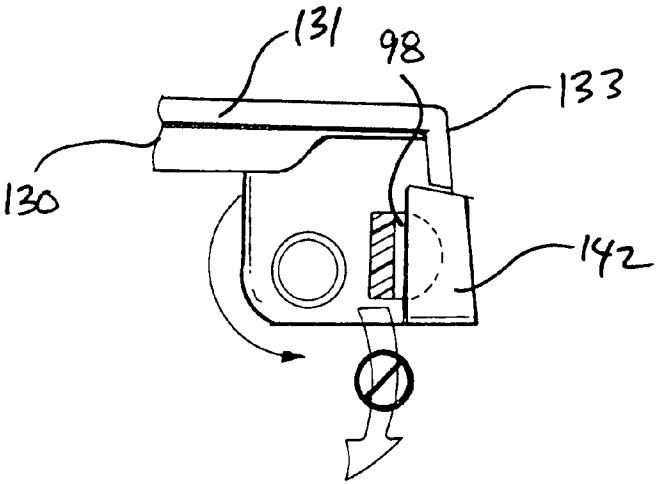
FIG. 16B is a view very similar to that of FIG. 16A illustrating the positioning of the engagement pair in their locked position in the closed position of the lid and the closed position of the closure.
Figure 16C:
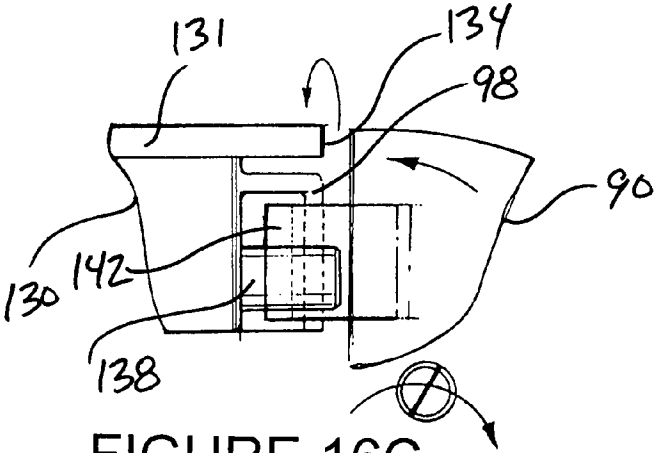
FIG. 16C is fragmented front elevational view of the engagement pair of FIG. 14 in their locked position in the closed position of the lid and the closed position of the closure.
Figure 18:
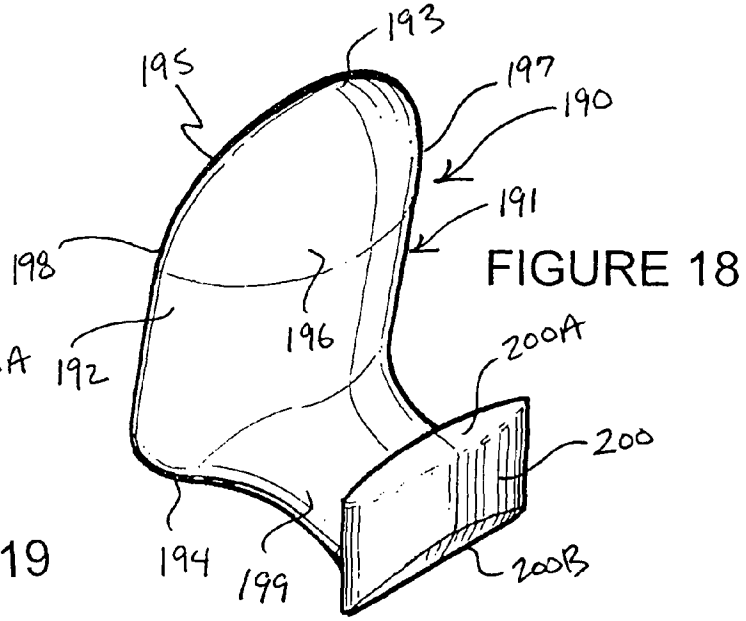
FIG. 18 is a perspective view of the splashguard of the potty bench of FIG. 1.
Figure 19:
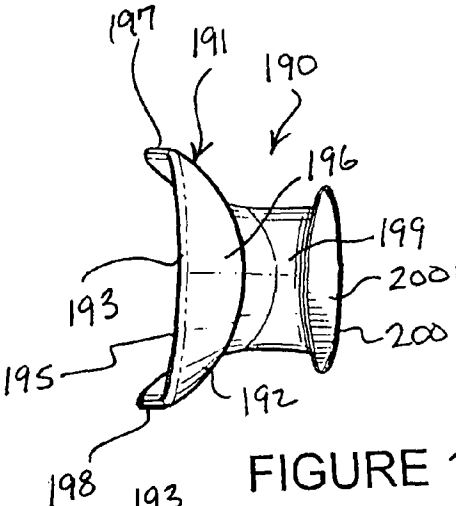
FIG. 19 is a top plan view of the splashguard of the potty bench of FIG. 1.
Figure 21:
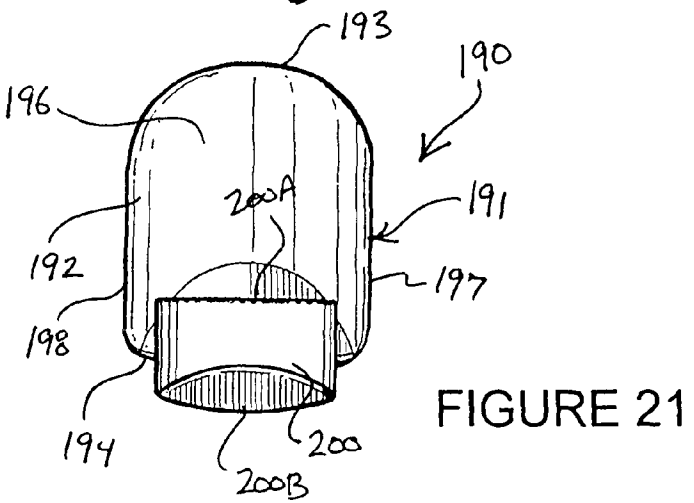
FIG. 21 is a rear elevational view of the splashguard of the potty bench of FIG. 1.
Figure 20:
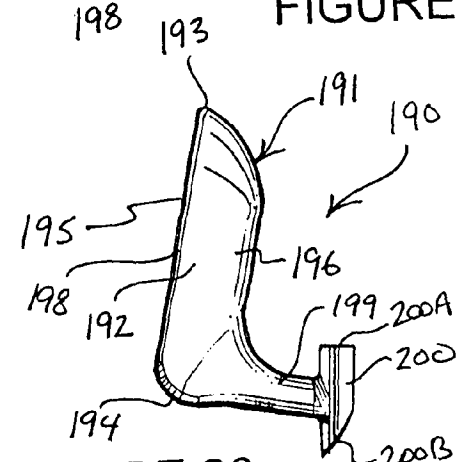
FIG. 20 is a side elevational view of the splashguard of the potty bench of FIG. 1, the opposing side elevational view being substantially the same thereof.

Referring back to FIG. 22, closure 90 is formed with an abutment 98 and lid 130 is formed with a catch 142 as seen in FIG. 14, which together constitute an engagement pair forming the locking assembly therebetween lid 130 and closure 90. Abutment 98 extends upwardly relative to outer edge 93A from endwall 92. Referring to FIG. 14, closure 90 is shown as it would appear in its closed position. In its closed position, abutment 98 of closure 90 extends toward side extremity 134 of lid 130 and into and through a small opening formed in dividing wall 141 rearwardly of opening 140. Lid 130 is fashioned with a catch 142, which is formed at rear extremity 133 of lid 130 rearwardly of pintle 138, and is supported outwardly from side extremity 134 opposing, and spaced from, pintle 138. In the open position of lid 130 according to FIGS. 15A and 16A, catch 142 underlies and is spaced from abutment 98. In the closed position of lid 130 according to FIGS. 15B, 16B, and 16C, the pivotal movement of lid 130 into its closed position brings catch 142 into a confronting relationship with abutment 98 between abutment 98 and dividing wall 141 thereby locking/securing closure 90 in its closed position in the closed position of lid 130, according to the principle of the invention. The described locking assembly that interacts between lid 130 in its lowered position and closure 90 in its closed position securing closure in its closed position is important because it prevents closure 90 from inadvertently opening while a user is standing on lid 130 in the stool configuration of potty bench 50, which could be dangerous for a user standing upon lid 130 in the stool configuration of potty bench 50. Moving lid 130 into its open position from its closed position takes catch 142 out of its confronting position relative to abutment 98 thereby unlocking or otherwise releasing closure 90 relative to lid 130 allowing closure 90 to be moved at will between its open and closed position in the open/raised position of lid 130.

According to the principle of the invention, abutment 90 is an element of the locking assembly between lid 130 and closure 90 and catch 142 is the complemental element of the locking assembly. These corresponding elements interact with one another in the closed position of closure 90 and the closed/lowered position of lid 130 securing/locking closure 90 in its closed position in the closed/lowered position of lid 130. According to the principle of the invention, any suitable structure capable of performing this function including an element thereof carried by lid 130 and a complemental element thereof carried by closure 90 may be used and positioned wherever desired relative to lid 130 and closure 90 without departing from the invention, including, but not limited to, corresponding tongue-and-groove elements, corresponding male and female engagement elements, etc. Furthermore, although closure 90 supports abutment 98 and lid 130 supports catch 142, this arrangement can be reversed, if desired.

Lid 130 and closure 100 are similarly configured with the described locking assembly between lid 130 and closure 90 for locking closure 100 in its closed position in the closed position of lid 130. Accordingly, it is to be understood that the foregoing discussion of the locking assembly between lid 130 and closure 90 applies in every respect to the locking assembly between lid 130 and closure 100 for locking closure 100 in place in its closed position in the closed position of lid 130. The locking assemblies between lid 130 and closures 90 and 100 may collectively be referred to as a locking assembly, which interacts between lid 130 and closures 90 and 100, whereby movement of lid 130 into its closed position in the closed positions of closures 90 and 100 locks closure 90 and 100 in their closed positions, and movement of lid 130 from its closed position to its open position in the closed positions of closures 90 and 100 unlocks closures 90 and 100 from their closed positions.

When seat 60 is positioned on top 56 of base 51 as shown in FIG. 3, an opening 150 is formed in base 51 between front extremity 121 of seat 60 and open end 111 of basin cradle 110. Basin 65 is movable relative to cradle basin 110 between an operative position into basin cradle 110 through opening 150 underlying potty seat opening 61 allowing it to receive and collect waste from potty seat opening 61, and a detached/removed/released position relative to cradle basin 110 through opening 150. In its operative position disposed in basin cradle 110 underlying potty seat opening 61 as shown in FIG. 4, basin 65 is operative for collecting waste, namely, feces and urine, expelled through potty seat opening 61 from a child using potty bench 50, in accordance with the principle of the invention. After removing basin 65 from base 51, the contents in basin 65 may be poured out and disposed of, such as in a toilet, and basin 65 conveniently cleaned in preparation for further use.

Referring to FIG. 17, basin 65 consists of a continuous sidewall 161 having a closed bottom 162, a continuous upper edge 163 defining an open top 163A opposing closed bottom 162, an inner end 164, and an outer end 165, which together cooperate to form a collection chamber 166 for accepting waste material. Outer end 165 is formed with a spout 167 from which contents in chamber 167 can be conveniently poured. Inner end 164 is formed with a coupling 168 projecting outwardly relative to inner end 164, and which is adapted to snap engage a handle 169 depicted in FIG. 11. In this embodiment, handle 169 is a separate component that is adapted to snap secure onto coupling 168 at inner end 164 of continuous sidewall 161 with a convenient and conventional snap fastener attachment. This is shown merely as a matter of example, with the understanding that handle 169 and continuous sidewall 161 may be formed as an integrated body, if desired. Handle 169, which is formed with a central depression 169A, is designed to assist a user in taking up basin 65 by hand and wielding basin 65. Referring to FIG. 17, upper edge 163 at the opposing sides of continuous sidewall 161 is formed with lips 170 and 171, respectively, which extend along substantially the entire length of basin 65 from inner end 164 to outer end 165.

Basin 65 is received into cradle basin 110 and maintained therein. Looking to FIG. 7, rails 113 and 114 are formed with opposed, inwardly directed shelves 113A and 114A, respectively. To place basin 65 into cradle basin 110 with potty seat 60 positioned onto top 56 as shown in FIG. 3, basin 65 is taken up by hand, such as at handle 169, and is inserted outer end 165 first into basin cradle 110 through opening 150 with open top 163A positioned upwardly. Basin 65 is sized such that lips 170 and 171 present onto shelves 113A and 114A respectively, supporting basin 54 in basin cradle 110. When fully inserted into cradle basin 110 through opening 150, lips 170 and 171 are received on shelves 113A and 114A, handle 169 encloses opening 150 and rests generally flush along front end 54 of base 21 as shown in FIGS. 1 and 2, and collection chamber 166 is positioned below potty seat opening 61 as shown in FIG. 4 for collecting waste falling into it through open top 163A from potty seat opening 61. When fully inserted into cradle basin 110 in its operative position underlying potty seat opening 61, potty seat opening 61 overlies and registers with open top 163A leading into collection chamber 166. Basin 65 can be simply removed by reversing the foregoing operation, namely, by simply taking up handle 169 by hand and pulling basin 65 outwardly from basin cradle 110 through opening 150.

Figures 11, 12:
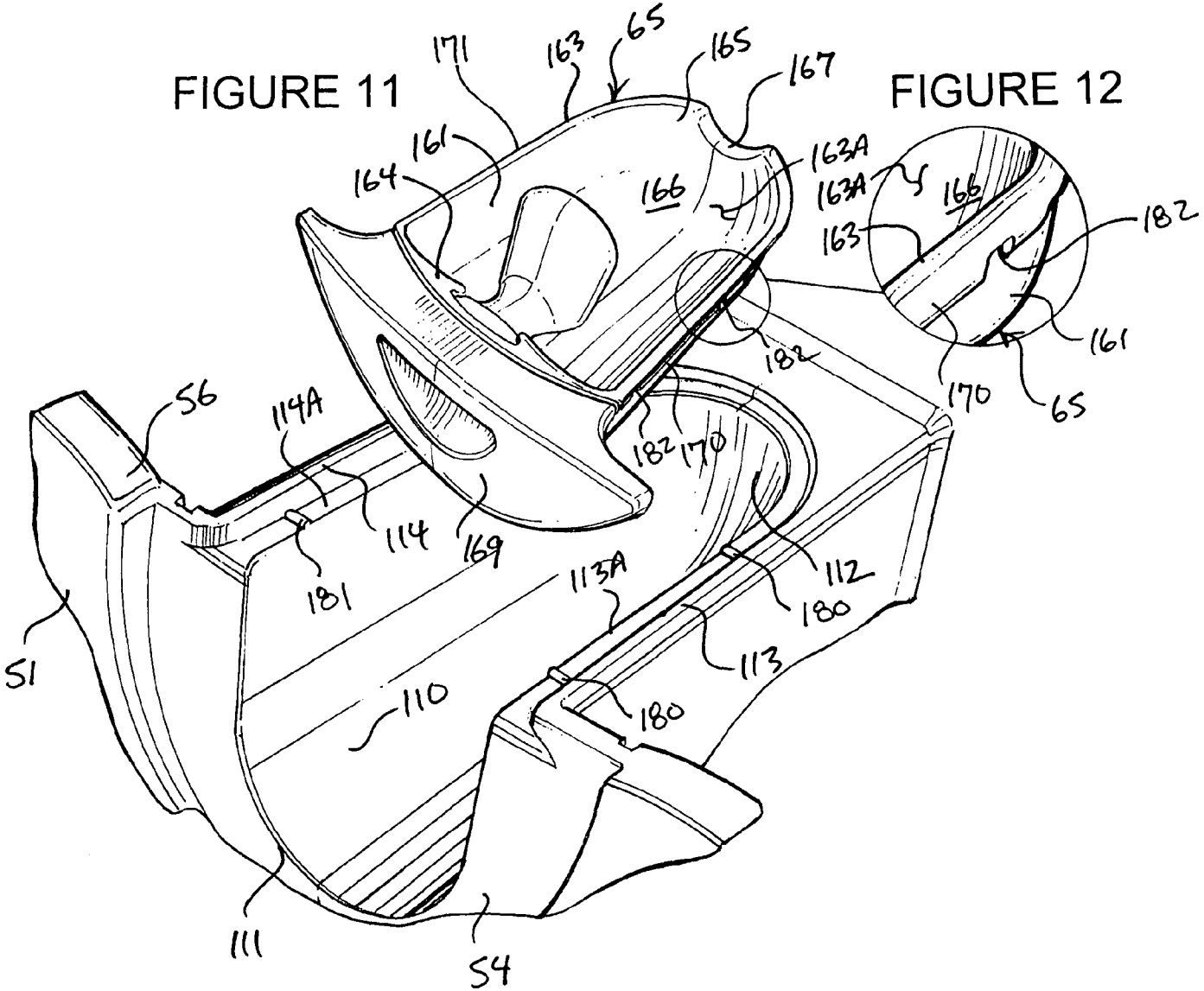
FIG. 11 is a fragmented perspective view of the base of FIG. 1 shown as it would appear with the waste collection basin detached therefrom.
FIG. 12 is an enlarged fragmented perspective of the waste collection basin of FIG. 11 showing a lip thereof formed with a notch.

Looking back to FIG. 11, shelf 113A is fashioned with opposed keys 180, and shelf 114A is fashioned with opposed keys 181, which are referenced in FIG. 7. Referring to FIGS. 11 and 17, lip 170 is formed with corresponding keyways 182. FIG. 12 is an enlarged fragmented perspective view of basin 65 illustrating a key 180 formed in lip 170. Although not expressly shown in the drawings, lip 171 is also formed with corresponding keyways identical to that of keyways 182 formed with lip 170. When basin 65 is fully inserted into basin cradle 65 through opening 165 formed at front end 54 of base 51 between front extremity 121 of body 120 and open end 111 of basin cradle 110, keys 180 register with and fall into keyways 182 formed in lip 170, and keys 181 register with and fall into the corresponding keyways formed in lip 170, thereby keying and retaining basin 65 in place relative to cradle basin 110.

The instant embodiment incorporates two keys 180 at shelf 113A and two corresponding keyways 182 formed in lip 170, although less or more corresponding key/keyway pairs can be used in conjunction with shelf 113A and lip 170 without departing from the invention. The instant embodiment incorporates two keys 181 at shelf 114A and two corresponding keyways formed in lip 171, although less or more corresponding key/keyway pairs can be used in conjunction with shelf 114A and lip 171 without departing from the invention.

Referring to FIG. 11, basin 65 carries a splashguard 190, which is preferably releasably attached to basin 65. Referring to FIGS. 18-21 in relevant part, splashguard 190 consists of an integrated body 191 fashioned of soft, flexible plastic, rubber, elastomer, or other similar material or combination of materials having shape memory, and includes an upstanding shield 192 having opposing upper and lower ends 193 and 194, opposing inner and outer faces 195 and 196, opposed sides 197 and 198, a bridge 199, and a tab 200. Tab 200 is spaced apart and opposes outer face 196, and is connected to lower end 194 of shield 192 with bridge 199. Tab 200 has opposing upper and lower ends 200A and 200B.

Inner end 164 of basin 65 is formed with a notch or groove 205 as seen in FIG. 17, which faces into collection chamber 166. To attach splashguard 190 to basin 65, splashguard 190 is taken up and its tab 200 is inserted lower end 200B first into notch 205 thereby retaining splashguard 190 relative to basin 65. Reversing this operation detaches splashguard 190 from basin 65. Notch 205 is open into collection chamber 166, and bridge 199 extends away from inner end 164 of basin 65 into collection 166 to shield 192, which is directed into collection chamber 166 from inner end 164. This represents the proper installation of splashguard 190 to basin 65. Lower end 200B of shield 192 is disposed in collection chamber 166. Shield 192 is disposed in a raised position in FIG. 17 extending substantially vertically upward from its lower end 200B through open top 163A to its upper end 200A, which is located above open top 163A, in which outer face 196 is directed toward inner end 164 of basin 65, and inner face 195 is directed toward outer end 165 of basin 65, in accordance with the principle of the invention.

Figure 5:
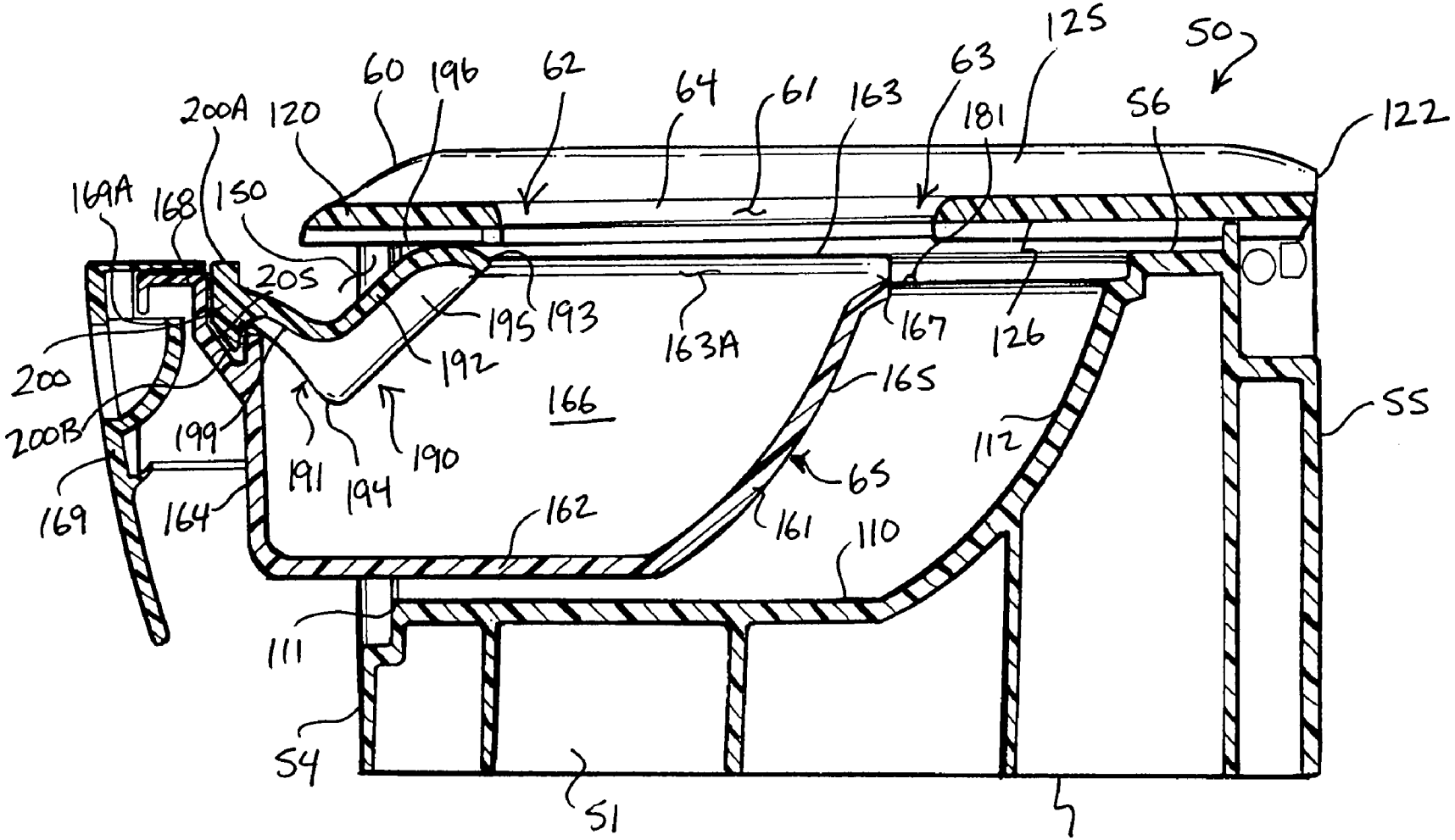
FIG. 5 is a view very similar to the view of FIG. 4 with the waste collection basin shown as it would appear partially withdrawn relative to the base, in which the splashguard is shown as it would appear deflected into the base.

Because splashguard 190 is fashioned of soft, flexible plastic, rubber, elastomer, or other similar material or combination of materials having shape memory, it is inherently deflectable and thereby cable of being forcibly deflected between its normal or raised position as shown in FIGS. 1, 4, and 11, and a lowered position into collection chamber 166 as shown in FIG. 5. Arcuate arrowed line A in FIG. 4 generally indicates the path of deflectable movement of splashguard 190.

To place basin 65 into cradle with potty seat 60 positioned on top 56 as shown in FIG. 3 with splashguard 190 attached thereto, basin 65 is taken up by hand, such as at handle 169, and is inserted outer end 165 first into basin cradle 110 through opening 150 with open top 163A directed upwardly. As basin 65 is being inserted into basin cradle 110 through opening 150, a downward force is applied, such as by hand, to outer face 196 of shield 192 deflecting it into collection basin 166 allowing its upper end 193 to pass through opening 150 beneath front extremity 121 of potty seat 60. At this point, the force applied to outer face 196 of shield 192 can be released. When the force applied to shield 192 deflecting it into collection chamber 166 is released, the shape memory characteristic of splashguard 190 will cause it to automatically move upwardly toward its raised position bringing outer face 196 into engagement with lower face 126 of potty seat 60 as shown in FIG. 5. At this point, the interaction of splashguard 190 with lower face 126 of potty seat 60 prevents splashguard from assuming its normal, upright position as illustrated in FIGS. 1 and 4. As basin 65 is slid into cradle basin 110 through opening 150, outer face 196 of splashguard 190 slides against lower face 126 of potty seat 60 toward potty seat opening 61. When basin 65 assumes its operative position as shown in FIG. 4, shield 192 is positioned rearwardly of the front portion of rim 64 directed toward front extremity 121 of potty seat 60 and is clear and thereby released from its engagement to lower face 126, in which the shape memory characteristic of splashguard 190 causes shield 192 to snap into, or otherwise assume, assume its raised, upright position as shown in FIGS. 1 and 4.

And so when basin 65 is fully inserted into basin cradle 110 in its operative position as shown in FIG. 4, shield 192 assumes its raised and upright position, whereby shield 192 of splashguard 190 projects upwardly from its lower end 194 at basin 65 through potty seat opening 61 past rim 64 at forward end 62 of potty seat opening 61 terminating with its upper end 193, which is disposed above seating face 125 of potty seat 60. In this orientation, outer face 196 of shield 192 faces front extremity 121 of potty seat 60 and front end of base 51 and confronts rim 64, and inner face 195 of shield 192 faces into potty seat opening 61 and, moreover, faces rear extremity 122 of potty seat 60, rearward end 63 of potty seat opening 61, and rear end 55 of base 21.

Inner face 195 is a urine deflecting face, which deflects urine into basin 65 through potty seat opening 61. In this embodiment, inner face 195 is substantially concave in shape, or otherwise substantially bow-shaped, and which is disposed upwardly relative to seating face 125 of potty seat 60, in accordance with the principle of the invention.

With lid 130 in its open position as in FIG. 1 whereby potty bench 50 is disposed in its potty configuration with basin 65 supporting splashguard 190 disposed in basin cradle in its operative position underlying potty seat opening 61 formed in potty seat 60, a young child may sit on seating face 125 and urinate and or defecate into potty seat opening 61, whereby the urine and feces passes downwardly through potty seat opening 61 and into collection chamber 166 through open top 163A of basin 65. Young boys have small, immature penises, which tend to stick straight out when the child is in a seated position on seating face 125. As a result, when a young boy sits on seating face 125 and to use potty bench 50 for urinating, the stream of urine produces from the child's penis tends to pass over potty seat 60 and outwardly onto the floor over front end 54 of base 21. However, the location of inner face 165 of shield 192 projecting upwardly through potty seat opening 61 and above seating face 125 at forward end 62 of potty seat opening 61 confronts the child's penis while he is sitting on seating face 125, in which the stream of urine directed from the penis is deflected by inner face 165 into collection chamber 166 of basin 65 through potty opening 61, in accordance with the principle of the invention. The substantial bowl/concave shape of inner face 165 of shield 192 of splashguard 190 prevents the urine hitting it from splashing outwardly, and serves to consolidate the urine hitting it and direct it into collection chamber 166 through potty seat opening 61, in accordance with the principle of the invention.

After a child uses potty bench 50 for defecation and urination, lid 130 may be closed. When lid 130 closes, its lower face 137 hits upper end 193 of splashguard 190, in which the weight of lid 130 deflects splashguard 190 downwardly into basin 65 allowing lid 130 to assume its closed position.

To remove basin 65 from basin cradle 110, handle 169 is taken up by hand and basin 65 is pulled outwardly from basin cradle 110 through opening 150. As basin 65 is pulled outwardly from cradle basin 110 through opening 150, outer face 196 of shield 192 confronting rim 64 interacts with rim 65 of potty seat 60 at forward end 62 of potty seat opening 61 and is deflected downwardly into collection chamber 166 through potty seat opening 61 as shown in FIG. 5 bringing outer face 196 of shield 192 into engagement with lower face 126 of potty seat 60 between rim 64 and front extremity 121 of potty seat 60. At this point, basin 65 is free to be removed from base 51 simply by pulling free of basin cradle 110 through opening 150. When basin 65 is pulled free of base 51, splashguard 190 automatically assumes is upright, raised position. At this point, waste collected in collection chamber 166 may be poured into a toilet through spout 167 and then basin 65 and splashguard 190 cleaned before reinserting basin 65 back into basin cradle 110. Because splashguard 190 is releasably attached to basin 65, it can be easily removed, cleaned, and then reinstalled.

Tab 200 and notch 205 represent an element and a complemental engagement element of an engagement pair, and are generally representative of male and female engagement elements of a male and female engagement pair for producing the releasable engagement of splashguard 190 to basin 65. Those having regard for the art will readily appreciate that any suitable form of male and female engagement pair, or other complementing pair of engagement and complemental engagement elements may be used for producing the releasable engagement of splashguard 190 to basin 65 consistent with the teachings set forth in this specification. As a matter of example, suitable forms of engagement pairs useful in releasably attaching splashguard 190 to basin 65 may include complementing hook-and-loop fasteners, complementing mutual snap fasteners, complementing key and keyway engagement elements, etc.

Base 51, potty seat 60, closures 90 and 100, and lid are preferably fashioned of molded plastic, other forms of materials can be used, such as wood, metal, etc., and may each be integrally formed as an integrated body, or fashioned as an assembly of two or more attached parts secured together with adhesive, rivets, screws, nut-and-bolt assemblies, etc. Plastic is the preferred material insofar as it is easy to clean and is a convenient material from which to manufacture components.

Figure 8:
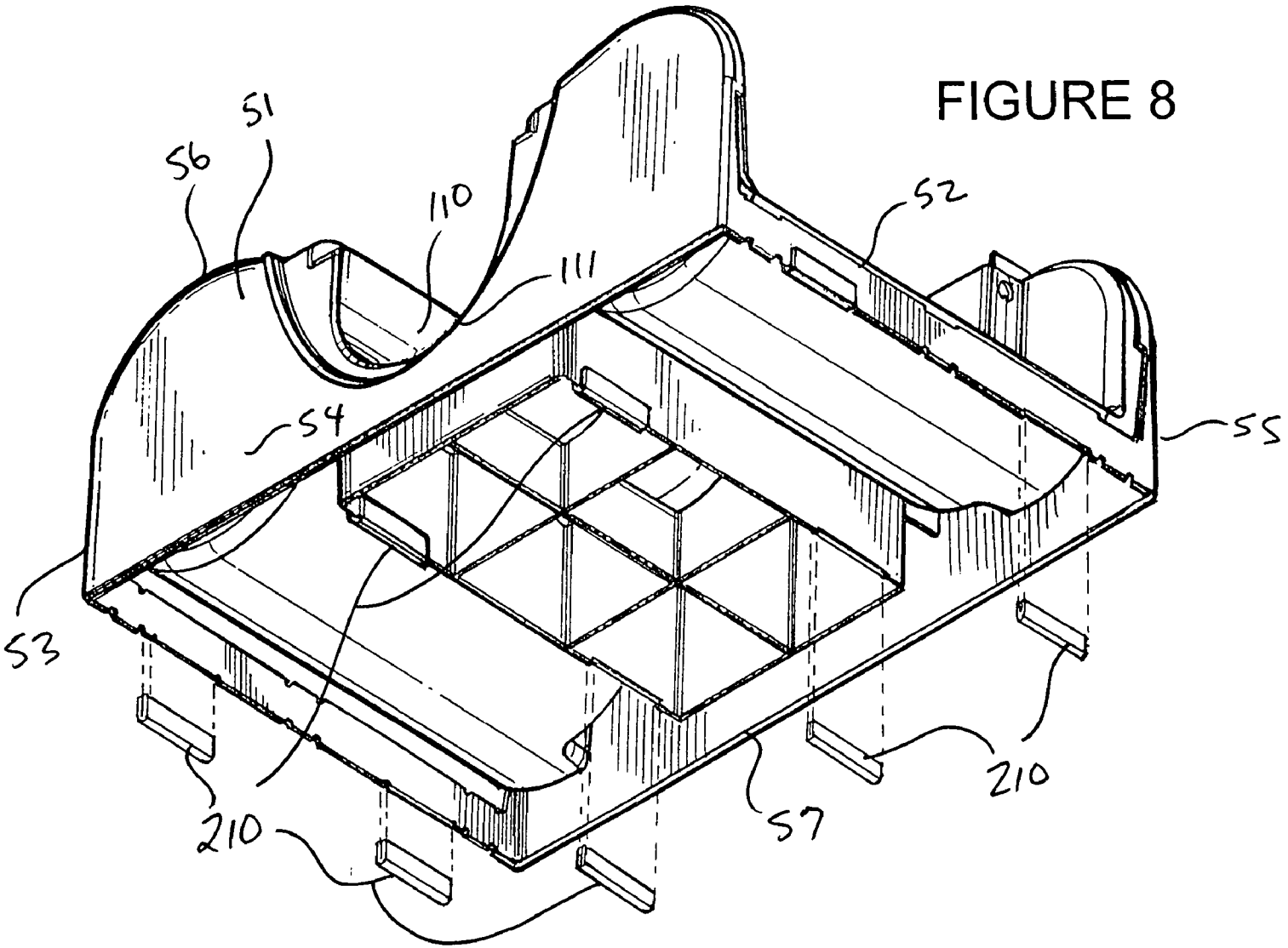
FIG. 8 is a bottom perspective view of the base of the potty bench of FIG. 1 and clips, some of which are shown attached to the base and some of which are shown detached from the base.
Figure 10:
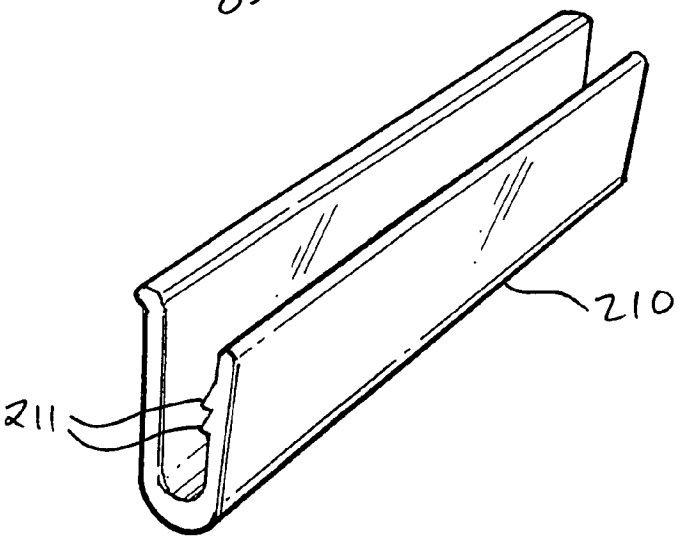
FIG. 10 is an enlarged perspective view of one of the clips shown in FIG. 8.

As a matter of example, FIG. 8 is a bottom perspective of base 51, which is shown it to be hollow having downwardly directed free edges forming bottom 57. This illustration in FIG. 8 represents the construction details of the interior of base 51 is it would appear having been formed of plastic. Clips 210 are provided, which clip onto the edges and which support base 51 against a supporting surface, and which prevent the edges of base 51 from scratching the surface onto which base 51 is set. As a matter of illustration, FIG. 10 is a greatly enlarged perspective view of one the clips 210, which is in integral U-shaped body formed with interior teeth 211 for biting into an edge at bottom 57 of base 51 for retaining it in place. Any suitable number of clips 210 can be used.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A potty bench, comprising:

a base supporting a potty seat formed with a potty seat opening into the base;

a basin carried by the base underlying the potty seat opening to collect waste from the potty seat opening;

a storage compartment formed in the base;

a closure for the storage compartment mounted to the base for movement between an open position opening an access opening to the storage compartment and a closed position closing the access opening to the storage compartment;

a lid mounted to the base for movement between an open position relative to the potty seat and a closed position relative to the potty seat;

means interacting between the lid and the closure, whereby movement of the lid into its closed position in the closed position of the closure locks the closure in its closed position, and movement of the lid from its closed position to its open position in the closed position of the closure unlocks the closure from its closed position;

a splashguard carried by the basin, the splashguard having a shield projecting through the potty seat opening from the basin and upwardly relative to the potty seat, the shield having a urine deflecting face for deflecting urine from above the potty seat into the basin through the potty seat opening;

the splashguard comprises a deflectable body;

the basin removable from the base through an opening into the base; and the deflectable body interacts with the potty seat in response to movement of the basin away from the base deflecting into the base permitting removal of the basin from the base.

2. The potty bench according to claim 1, further comprising a toilet paper spindle mounted to the base extending into the storage compartment.

3. The potty bench according to claim 2, further comprising:

the storage compartment including a support surface opposing the access opening; and the toilet paper roll spindle mounted to the base for movement between a first position toward the access opening away from the support surface, and a second position toward the support surface and away from the access opening.

4. The potty bench according to claim 3, further comprising the spindle biased into its second position.

5. The potty bench according to claim 1, wherein the potty seat has an annular seating surface sloped toward the potty seat opening.

6. The potty bench according to claim 1, further comprising means removably attaching the splashguard to the basin including an element thereof carried by the splashguard releasable coupled to a complemental element thereof carried by the basin.

7. The potty bench according to claim 6, wherein the element of the engagement assembly comprises one of a male engagement element and a female engagement element, and the complemental element of the engagement assembly comprises the other of the male engagement element and the female engagement element.

8. The potty bench according to claim 1, wherein the urine deflecting surface is substantially concave.

9. A potty bench, comprising:

a base including opposed sides;

a potty seat carried by the base between the respective sides thereof, the potty seat formed with a potty seat opening into the base;

a basin carried by the base underlying the potty seat opening to collect waste from the potty seat opening;

a storage compartment formed in each of the respective sides of the base;

a closure for each of the storage compartments mounted to the base for movement between open positions opening access openings to the respective storage compartments and closed positions closing the access openings to the respective storage compartments;

a lid mounted to the base for movement between an open position relative to the potty seat and a closed position relative to the potty seat;

means interacting between the lid and the closures, whereby movement of the lid into its closed position in the closed positions of the closures locks the closures in their closed positions, and movement of the lid from its closed position to its open position in the closed positions of the closures unlocks the closures from their closed positions;

a splashguard carried by the basin, the splashguard having a shield projecting through the potty seat opening from the basin and upwardly relative to the potty seat, the shield having a urine deflecting face for deflecting urine from above the potty seat into the basin through the potty seat opening;

the splashguard comprises a deflectable body;

the basin removable from the base through an opening into the base; and the deflectable body interacts with the potty seat in response to movement of the basin away from the base deflecting into the base permitting removal of the basin from the base.

10. The potty bench according to claim 9, further comprising a toilet paper spindle mounted to the base extending into one of the storage compartments.

11. The potty bench according to claim 10, further comprising:

the one of the storage compartments including a support surface opposing the access opening thereof; and the toilet paper roll spindle mounted to the base for movement between a first position toward the access opening away from the support surface of the one of the storage compartments, and a second position toward the support surface and away from the access opening of the one of the storage compartments.

12. The potty bench according to claim 11, further comprising the spindle biased into its second position.

13. The potty bench according to claim 9, wherein the potty seat has an annular seating surface sloped toward the potty seat opening.

14. The potty bench according to claim 9, further comprising means removably attaching the splashguard to the basin including an element thereof carried by the splashguard releasable coupled to a complemental element thereof carried by the basin.

15. The potty bench according to claim 14, wherein the element of the engagement assembly comprises one of a male engagement element and a female engagement element, and the complemental element of the engagement assembly comprises the other of the male engagement element and the female engagement element.

16. The potty bench according to claim 9, wherein the urine deflecting surface is substantially concave.

* * * * *